US012440001B2

(12) United States Patent
Burt et al.

(10) Patent No.: US 12,440,001 B2
(45) Date of Patent: Oct. 14, 2025

(54) MICRO-ADJUSTABLE ROTARY CLOSURE

(71) Applicant: Pride Manufacturing Company, LLC, Brentwood, TN (US)

(72) Inventors: John Robert Burt, Brentwood, TN (US); Lee Paul Shuttleworth, Brentwood, TN (US)

(73) Assignee: Pride Manufacturing Company, LLC, Brentwood, TN (US)

( * ) Notice: Subject to any disclaimer, the term of this patent is extended or adjusted under 35 U.S.C. 154(b) by 343 days.

(21) Appl. No.: 18/171,183

(22) Filed: Feb. 17, 2023

(65) Prior Publication Data

US 2023/0255320 A1 Aug. 17, 2023

Related U.S. Application Data

(60) Provisional application No. 63/311,178, filed on Feb. 17, 2022.

(51) Int. Cl.
*A43C 11/16* (2006.01)
*B65H 75/44* (2006.01)

(52) U.S. Cl.
CPC ..... *A43C 11/165* (2013.01); *B65H 75/4428* (2013.01); *B65H 75/4431* (2013.01); *B65H 75/4436* (2013.01); *B65H 75/4442* (2013.01); *B65H 75/4471* (2013.01); *B65H 75/4492* (2013.01)

(58) Field of Classification Search
CPC ... A43C 11/16; A43C 11/165; B65H 75/4418; B65H 75/4428; B65H 75/4431; B65H 75/4436; B65H 75/4442; B65H 75/4471; B65H 75/4492
USPC ..... 242/394, 395, 396.2, 396.4
See application file for complete search history.

(56) References Cited

U.S. PATENT DOCUMENTS

| | | | | |
|---|---|---|---|---|
| 9,706,814 | B2 * | 7/2017 | Converse | A61F 5/0123 |
| 10,251,451 | B2 * | 4/2019 | Converse | A61F 5/0123 |
| 10,959,492 | B2 * | 3/2021 | Converse | A43C 11/00 |
| 11,717,056 | B2 * | 8/2023 | Converse | A43C 11/1406 242/381 |
| 11,849,809 | B1 * | 12/2023 | Xiang | A43C 1/06 |
| 11,982,334 | B1 * | 5/2024 | Jiang | A43C 7/00 |
| 2013/0092780 | A1 * | 4/2013 | Soderberg | A43C 11/165 242/397 |
| 2014/0359981 | A1 * | 12/2014 | Cotterman | A43C 11/165 24/712.9 |
| 2015/0014463 | A1 * | 1/2015 | Converse | A43C 11/165 242/396.1 |
| 2015/0313319 | A1 * | 11/2015 | Ha | A43C 11/165 24/712 |
| 2016/0066653 | A1 * | 3/2016 | Piva | A43C 7/00 248/332 |

(Continued)

*Primary Examiner* — Anna M Momper
*Assistant Examiner* — Raveen J Dias
(74) *Attorney, Agent, or Firm* — Dentons Durham Jones Pinegar; Sarah W. Matthews; Lilly Gofrey

(57) ABSTRACT

Various embodiments of a system and associated methods for an improved rotary closure for tensioning a tensioned lacing element are disclosed herein. In particular, the improved rotary closure includes an adjuster component in association with a tensioning component to incrementally counter-rotate the tensioning component and a tensioned cylindrical device, enabling micro-adjustment of the rotary closure without complete de-tensioning of the tensioned cylindrical device.

18 Claims, 16 Drawing Sheets

(56) References Cited

U.S. PATENT DOCUMENTS

| | | | | |
|---|---|---|---|---|
| 2016/0120267 | A1* | 5/2016 | Burns | A43C 11/20 24/68 C |
| 2017/0295888 | A1* | 10/2017 | Chen | A43C 11/165 |
| 2017/0303643 | A1* | 10/2017 | Converse | A43C 11/00 |
| 2017/0325548 | A1* | 11/2017 | Ha | A43C 11/165 |
| 2019/0000187 | A1* | 1/2019 | Chen | B65H 75/4402 |
| 2019/0150569 | A1* | 5/2019 | Chen | A43C 11/00 |
| 2019/0200706 | A1* | 7/2019 | Huang | A43C 1/00 |
| 2019/0216176 | A1* | 7/2019 | Converse | A43B 3/38 |
| 2020/0128918 | A1* | 4/2020 | Chen | A43C 11/165 |
| 2020/0128919 | A1* | 4/2020 | Burt | E05C 3/122 |
| 2020/0345107 | A1* | 11/2020 | Burt | A43C 17/02 |
| 2020/0346888 | A1* | 11/2020 | Kruse | B65H 75/30 |
| 2021/0127794 | A1* | 5/2021 | Chen | A43C 11/06 |
| 2021/0251343 | A1* | 8/2021 | Martin | A43C 11/165 |
| 2021/0259366 | A1* | 8/2021 | Converse | A61F 5/0104 |
| 2021/0269275 | A1* | 9/2021 | Kim | B65H 54/02 |
| 2021/0284483 | A1* | 9/2021 | Chen | A43C 11/165 |
| 2022/0265001 | A1* | 8/2022 | Burt | A43C 11/165 |
| 2023/0056011 | A1* | 2/2023 | Chen | A43C 11/165 |
| 2023/0092419 | A1* | 3/2023 | Chen | A43C 11/165 24/712.2 |
| 2023/0234809 | A1* | 7/2023 | Huang | B65H 75/4492 242/395 |
| 2023/0248116 | A1* | 8/2023 | Duller | A43C 11/165 24/68 SK |
| 2024/0000194 | A1* | 1/2024 | Chen | B65H 75/4492 |
| 2024/0008598 | A1* | 1/2024 | Chen | A43B 13/04 |
| 2024/0074541 | A1* | 3/2024 | Converse | A43C 11/12 |
| 2024/0180295 | A1* | 6/2024 | Liu | A43C 11/165 |

* cited by examiner

MICRO-ADJUSTABLE ROTARY CLOSURE

CROSS-REFERENCE TO RELATED APPLICATIONS

This is a US Non-Provisional patent application that claims benefit to U.S. Provisional Patent Appln. 63/311,178 filed 17 Feb. 2022, which is herein incorporated by reference in its entirety FIELD The present disclosure generally relates to a micro-adjustable rotary closure and a method of assembling and operating the improved rotary closure.

BACKGROUND

Rotary closure systems include tensioning components with catch springs that prevent unintentional back-rotation and de-tensioning of a tensioned cylindrical device (e.g., a spool). Previous efforts in rotary closure systems require that, to de-tension a tensioned cylindrical device, the tensioning component completely releases the tensioned cylindrical device which allows the tensioned cylindrical device to fully de-tension. While previous designs enable the tensioned cylindrical device to be incrementally tensioned in the first rotational direction, oftentimes the tensioned cylindrical device cannot be incrementally de-tensioned. Rather, if a user has tightened a tensioned lacing element around the tensioned cylindrical device too far, the user must completely de-tension and re-wind the tensioned cylindrical device again. This can be frustrating and time-consuming or can otherwise cause discomfort if the rotary closure is being used to tighten shoelaces or other garments.

It is with these observations in mind, among others, that various aspects of the present disclosure were conceived and developed.

BRIEF DESCRIPTION OF THE DRAWINGS

Corresponding reference characters indicate corresponding elements among the view of the drawings. The headings used in the figures do not limit the scope of the claims.

DETAILED DESCRIPTION

Figure 1:
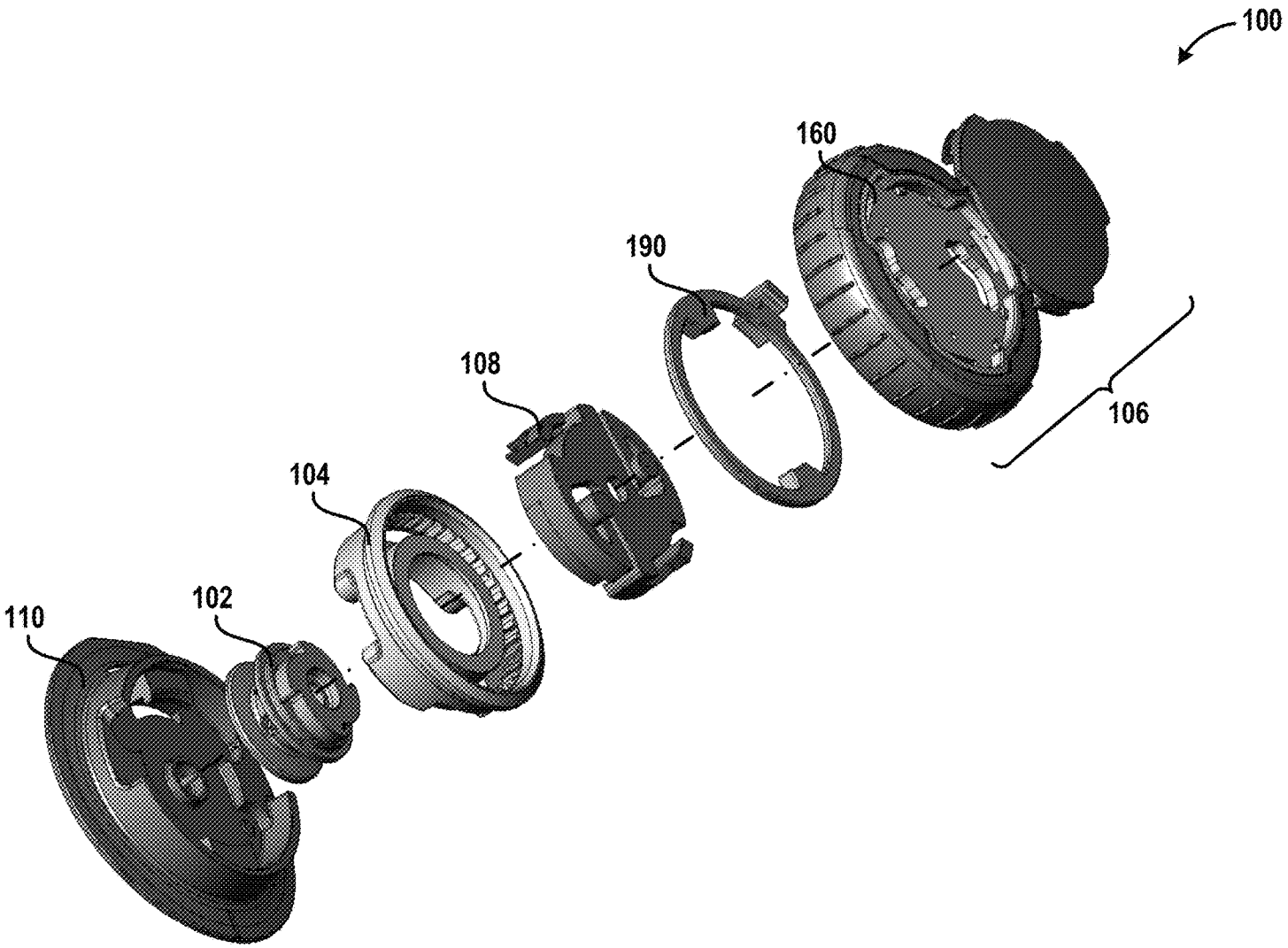
FIG. 1 is an illustration showing an exploded view of a micro-adjustable rotary closure.

A rotary closure enables releasable micro-adjustment of tension on a tensioned lacing element. The rotary closure includes a tensioned cylindrical device positioned within a housing and rotatable by a dial and an associated tensioning component that tensions the tensioned cylindrical device when the dial is rotated in a first rotational direction. Notably, the rotary closure also includes an adjuster component in operative association with the tensioning component and the housing that incrementally de-tensions the tensioned cylindrical device when rotated in an opposite second rotational direction. This operation enables a user to release tension on the tensioned lacing element in smaller increments, allowing the user to adjust the rotary closure to a more comfortable tension "setting" without requiring the user to fully release and then re-tension the tensioned cylindrical device.

Micro-Adjustable Rotary Closure

FIGS. 1-4C show a micro-adjustable rotary closure, hereinafter "rotary closure 100". As shown, the rotary closure 100 includes an adjuster component 190, a tensioned cylindrical device 102 coaxially disposed within a housing 104 and configured for tensioning a tensioned lacing element 198 (FIG. 2B) when rotated in a first rotational direction Q, and a tensioning component 108 in operative association with the tensioned cylindrical device 102 and the adjuster component 190. The tensioned cylindrical device 102 and tensioning component 108 can be rotated or otherwise controlled by a dial 106 having a cam component 160 that controls operation of the tensioning component 108. In some embodiments, the tensioned cylindrical device 102 is a spool for winding and un-winding a tensioned lacing element of an item, such as a shoe or a container.

Figure 2A:
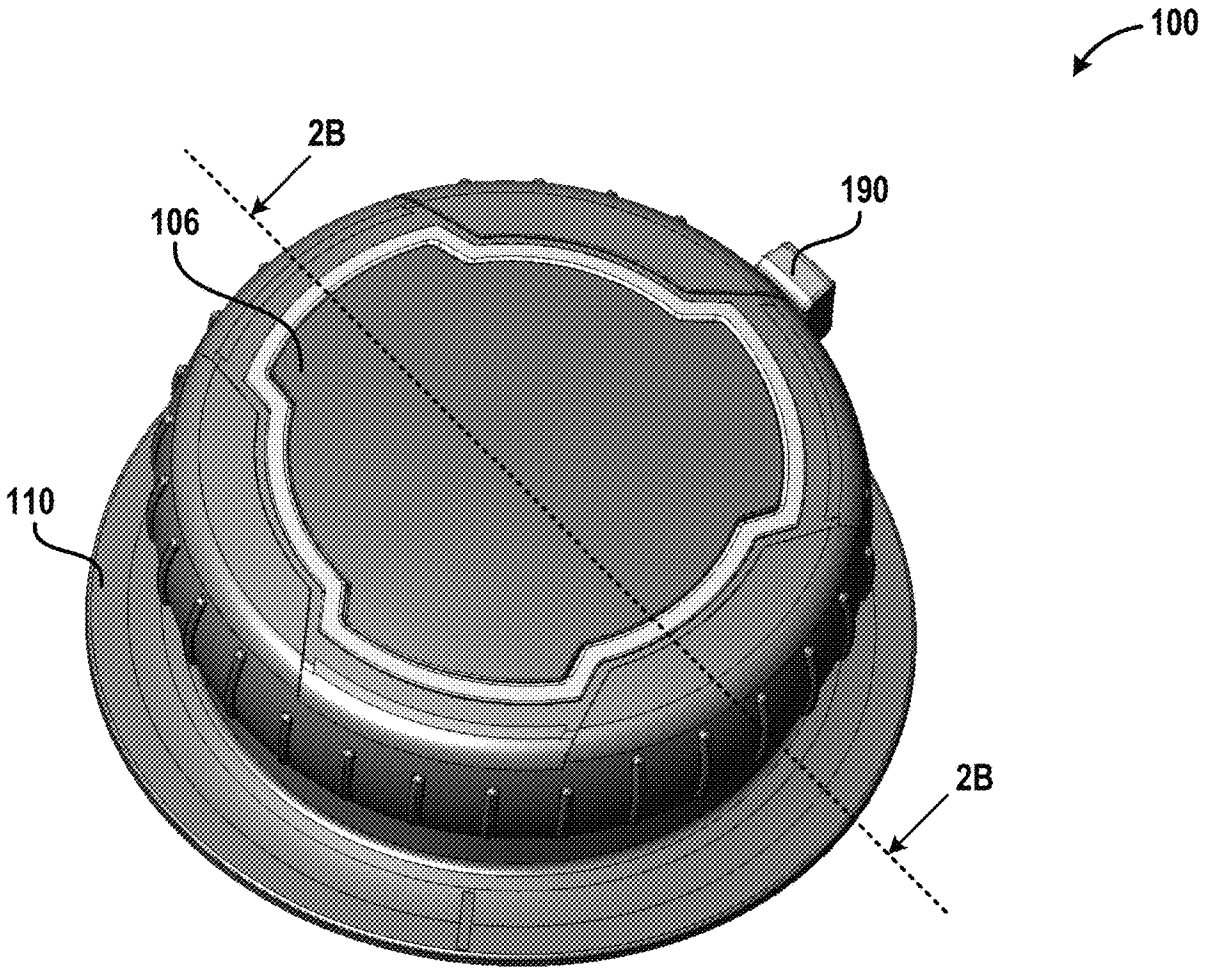
FIG. 2A is an illustration showing an assembled view of the micro-adjustable rotary closure of FIG. 1.
Figure 2B:
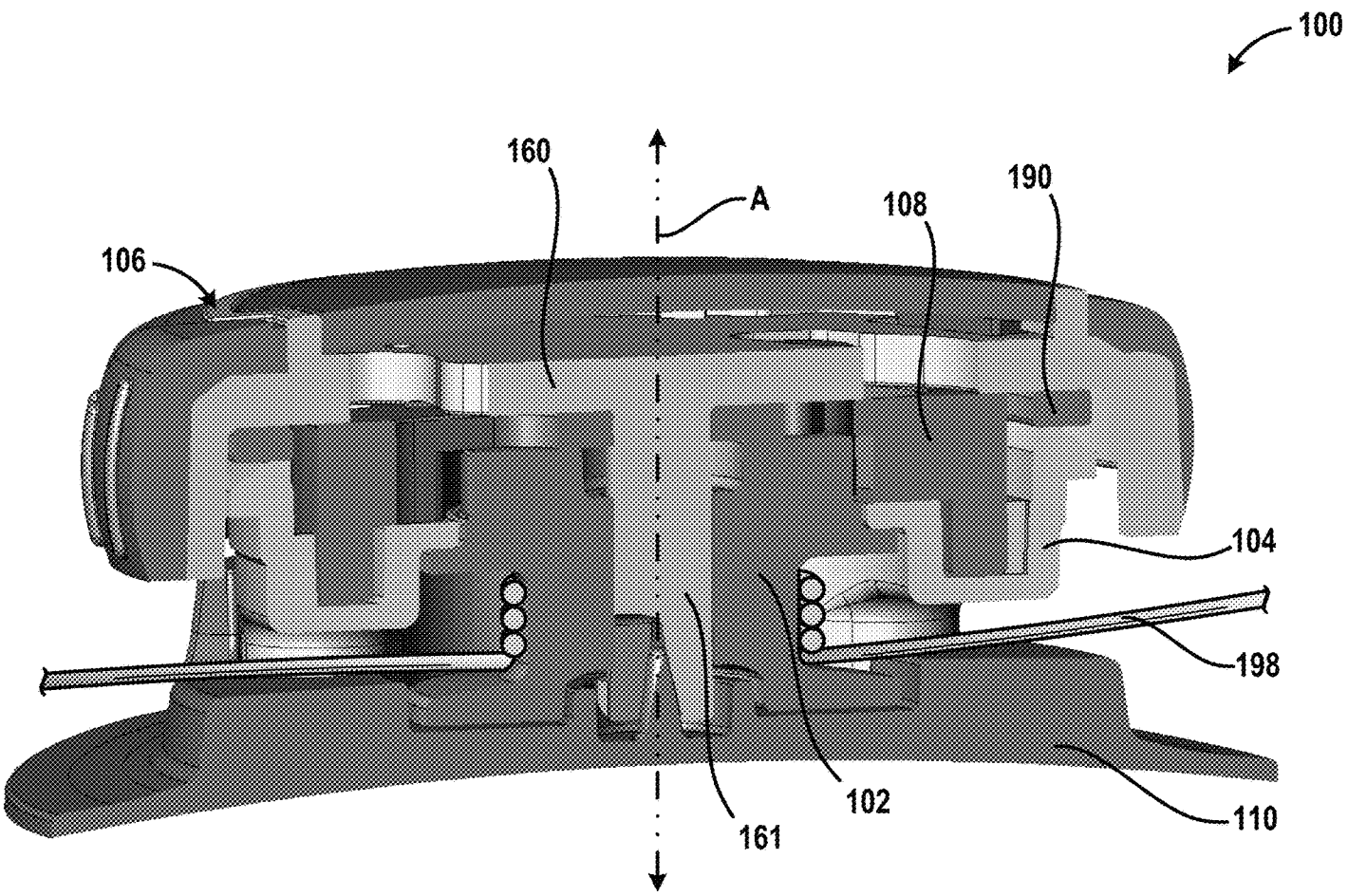
FIG. 2B is an illustration showing a sectioned view of the micro-adjustable rotary closure taken across line 2B-2B of FIG. 2A.

FIG. 1 shows an exploded view of the rotary closure 100 including a flange 110 that can couple with a shoe or another device. As shown, the flange 110 receives the tensioned cylindrical device 102, the housing 104, the tensioning component 108, the adjuster component 190, and the dial 106 in a coaxial arrangement along the common center axis A. FIGS. 2A and 2B respectively show an assembled view and a corresponding cross-sectional view of the rotary closure 100, where the tensioned cylindrical device 102 is shown nested within the housing 104, and the tensioning component 108 rests between the housing 104 and the dial 106 as shown. As shown, the dial 106 can include a latching extension 161 extending along the common center axis A configured to latch components of the rotary closure 100 together along the common center axis A.

Figure 3A:
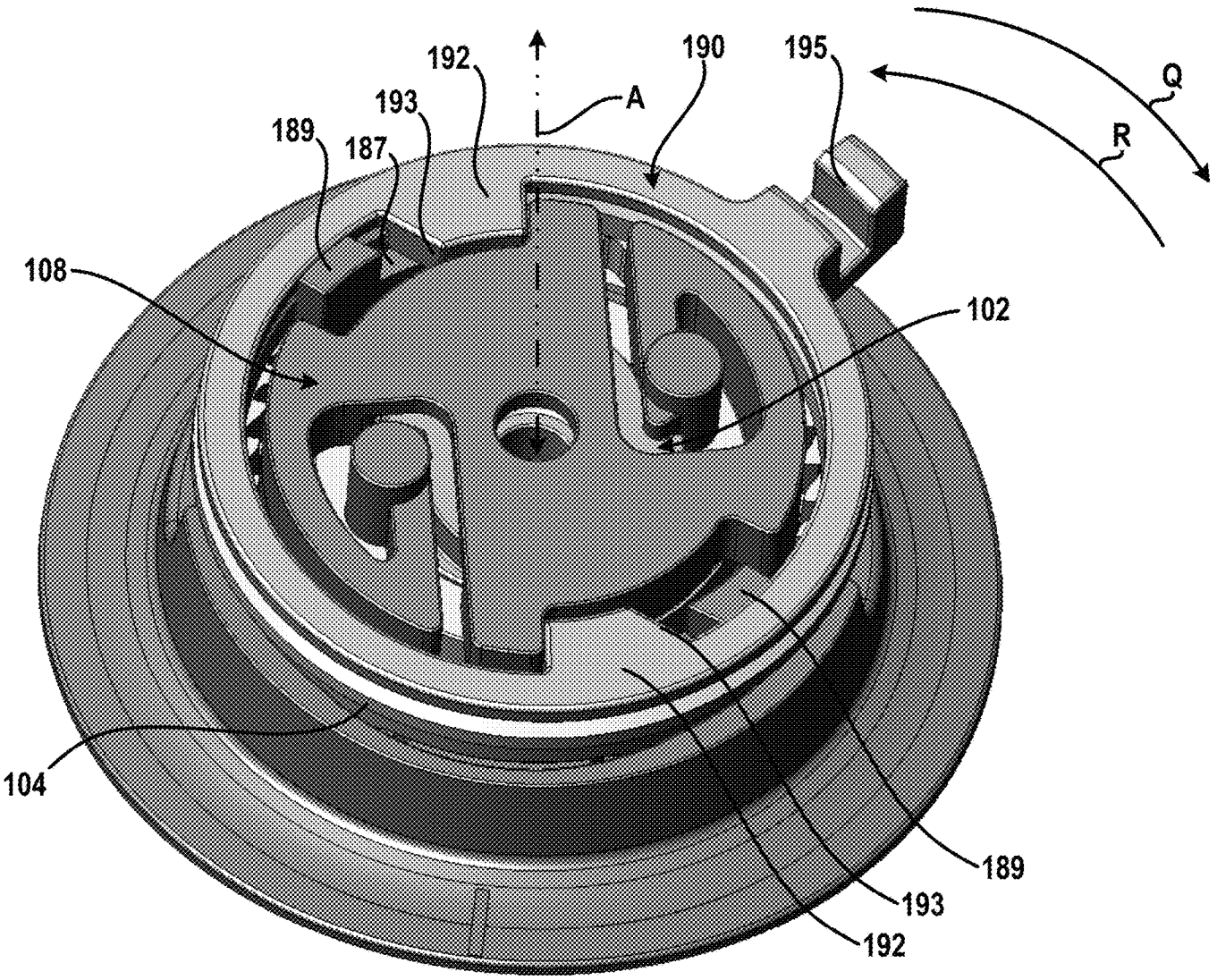
FIG. 3A is an illustration showing a perspective view of the micro-adjustable rotary closure of FIG. 1 with the dial removed, and showing an adjuster component in operative engagement with a tensioning component.
Figure 3B:
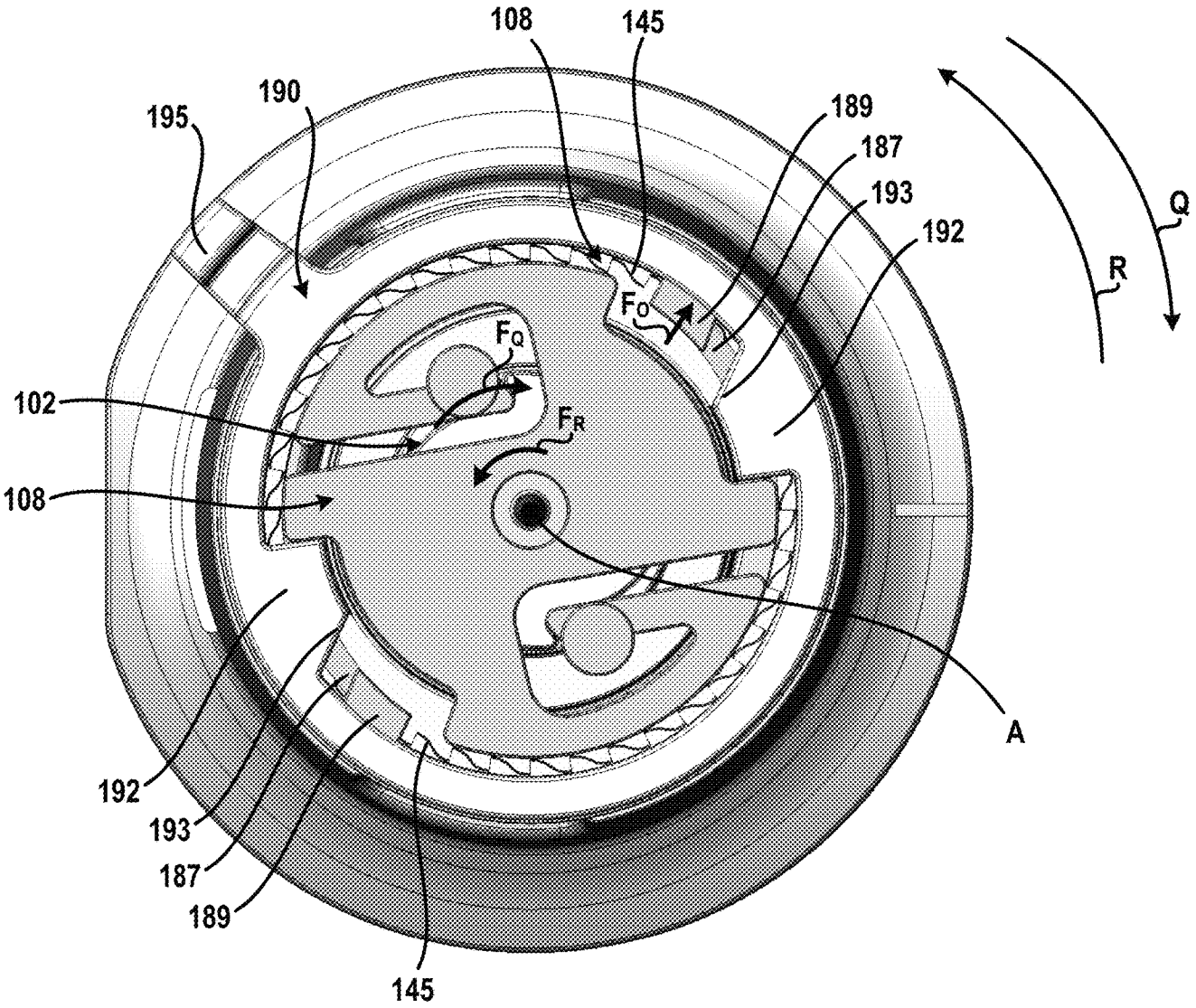
FIG. 3B is an illustration showing a top plan view of the micro-adjustable rotary closure of FIG. 3A and showing the micro-adjustable rotary closure in the first "default" configuration when at rest or when winding the tensioned cylindrical device.
Figure 3C:
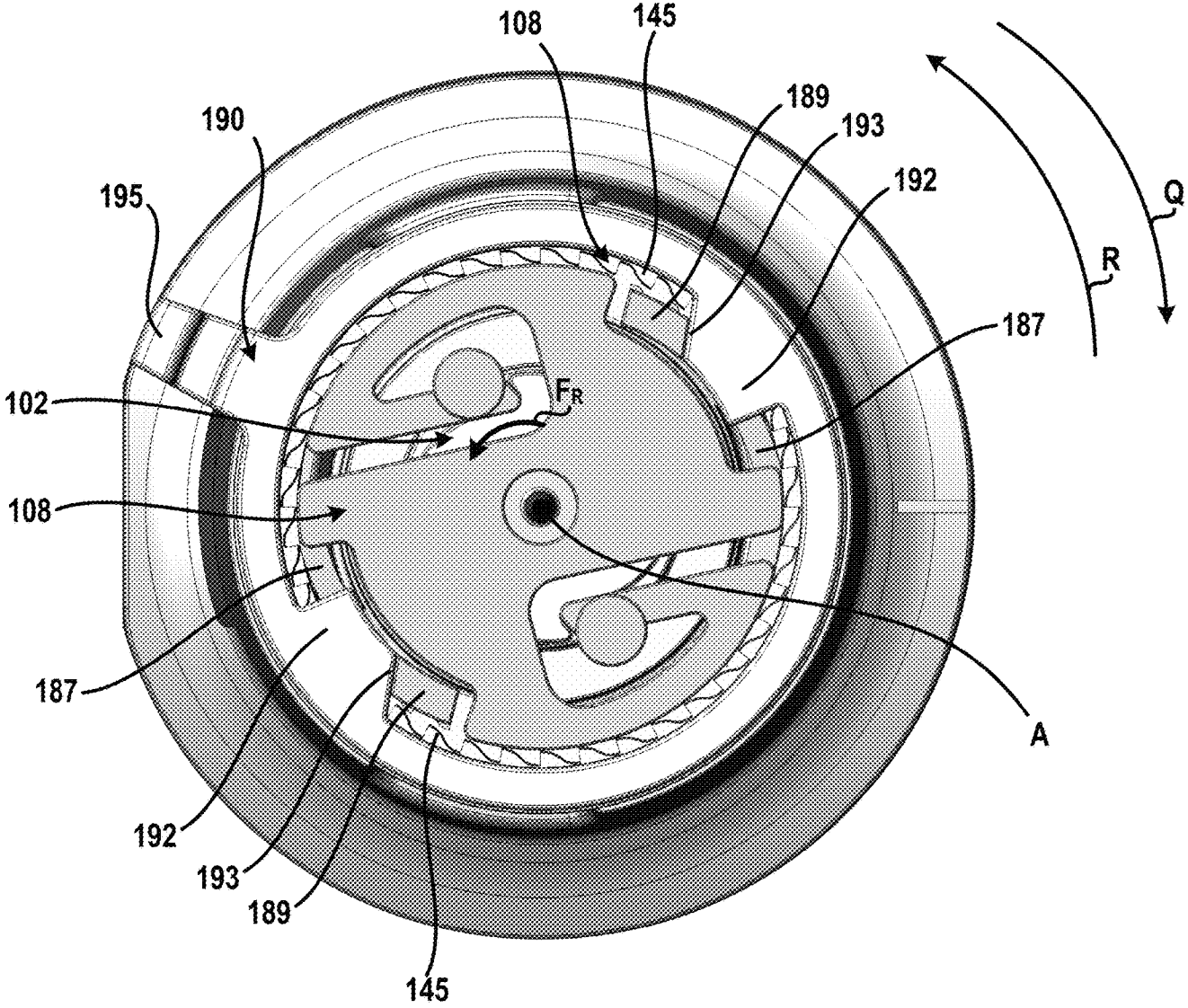
FIG. 3C is an illustration showing a top plan view of the micro-adjustable rotary closure of FIG. 3B showing the micro-adjustable rotary closure in the second "micro-release" configuration.

With reference to FIGS. 3A-3C, the tensioned cylindrical device 102, when rotated in the first rotational direction Q, generates a rotational force $F_R$ along the second rotational direction R. The tensioning component 108 is configured to apply a contrary rotational force $F_Q$ along the first rotational direction Q to prevent rotation of the tensioned cylindrical device 102 in the second rotational direction R. As shown, the tensioning component 108 includes a catch spring 187 biased to apply an outward lateral force $F_O$ against the housing 104 and prevent rotation of the tensioning component 108 in a second rotational direction R when the catch spring 187 is engaged with the housing 104. The adjuster component 190 includes an adjuster block 192 having an angled edge 193 that operatively engages the catch spring 187 to adjust a rotational position of the catch spring 187 along the housing 104, and consequently, the tensioned cylindrical device 102. Rotation of the adjuster component 190 in the second rotational direction R causes the angled edge 193 to contact the catch spring 187 and cause the catch spring 187 to disengage from the housing 104 such that the tensioning component 108 and tensioned cylindrical device 102 are allowed to rotate by an increment in the second rotational direction R. Disengagement from the housing 104 is temporary, as releasing the adjuster component 190 causes the catch spring 187 to "snap" outward to engage the housing 104. In some embodiments, the adjuster component 190 includes an outer tab 195 that extends beyond the housing 104 for manual actuation.

The catch spring 187 is biased away from a common center axis A of the rotary closure 100. When at rest or during tensioning of the tensioned cylindrical device 102, the catch spring 187 pushes a catch spring block 189 of the catch spring 187 outward from the common center axis A to engage the housing 104. Upon rotation of the adjuster component 190 in the second rotational direction R, the angled edge 193 of the adjuster component 190 contacts the catch spring block 189 of the catch spring 187 and pushes the catch spring block 189 inward towards the common center axis A.

As shown in FIG. 3B, the housing 104 can include a plurality of teeth 145 around an interior surface of the housing 104 that engage the catch spring 187 of the tensioning component 108. When at rest, the catch spring 187 engages one of the plurality of teeth 145 to prevent back-rotation of the tensioning component 108 and the tensioned cylindrical device 102. When the tensioning component 108 is rotated in the first rotational direction Q, the catch spring 187 releasably engages the plurality of teeth 145 of the housing 104 to advance a rotational position of the catch spring 187 in the first rotational direction Q along the housing 104. The plurality of teeth 145 of the housing 104 are angled to allow the catch spring 187 of the tensioning component 108 to move radially inward and then snap radially outward again as the tensioning component 108 is rotated in the first rotational direction Q. The angled configuration of the plurality of teeth 145 of the housing 104 also prevents unintentional back-rotation of the tensioned cylindrical device 102. As shown in FIG. 3C, to release tension from the tensioned cylindrical device 102 in small increments, rotation of the adjuster component 190 in the second rotational direction R causes the catch spring 187 to disengage from the plurality of teeth 145 of the housing 104 such that the tensioned cylindrical device 102 is allowed to freely rotate in the second rotational direction R.

Figure 4A:
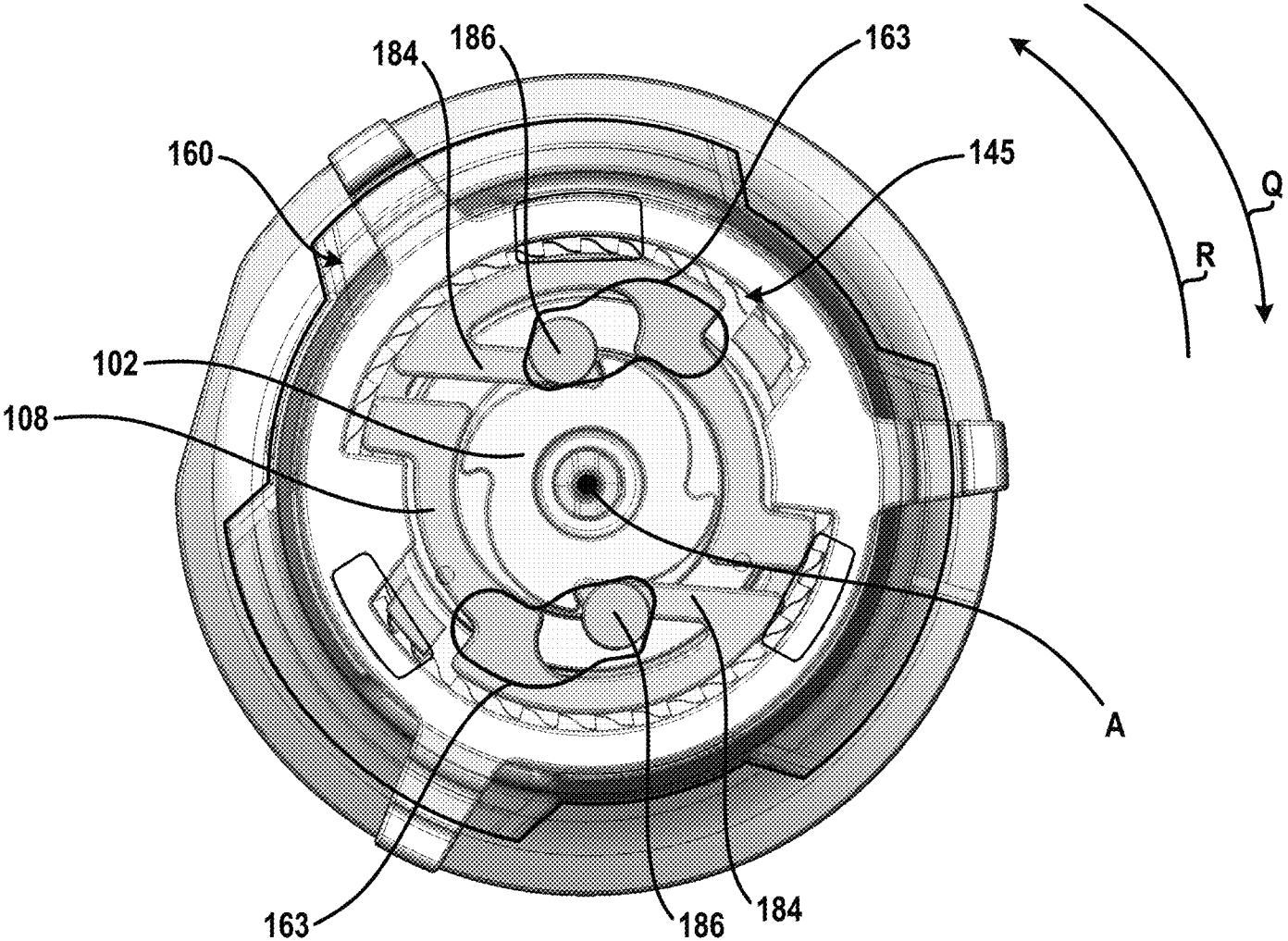
FIG. 4A is an illustration showing a top plan view of the micro-adjustable rotary closure of FIG. 1 with a dial cover and gripping portion removed and with a cam component shown in phantom, and showing the micro-adjustable rotary closure in a first "default" configuration when at rest or when winding the tensioned cylindrical device.
Figure 4B:
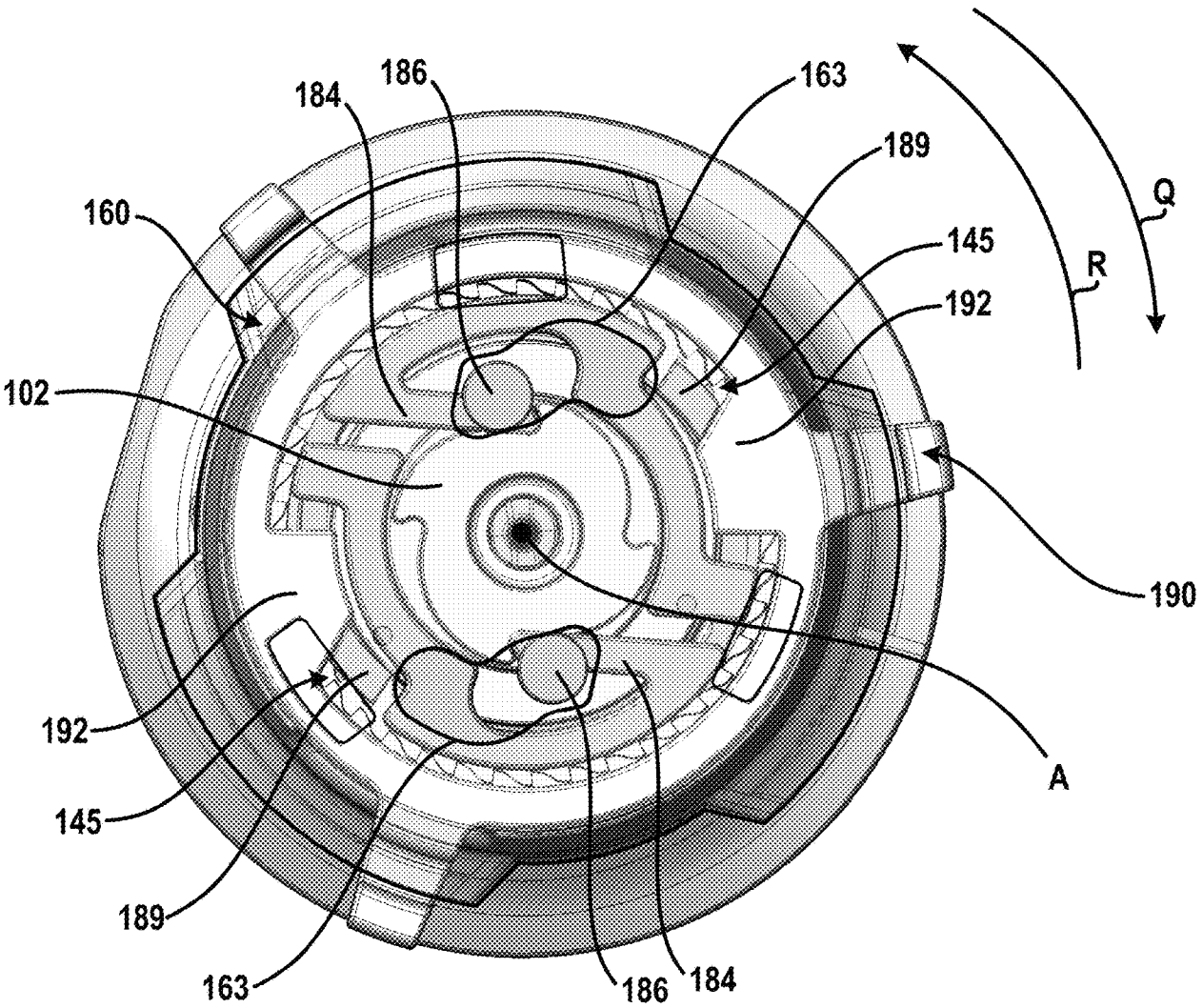
FIG. 4B is an illustration showing a top plan view of the micro-adjustable rotary closure of FIG. 4A showing the micro-adjustable rotary closure in a second "micro-release" configuration.
Figure 4C:
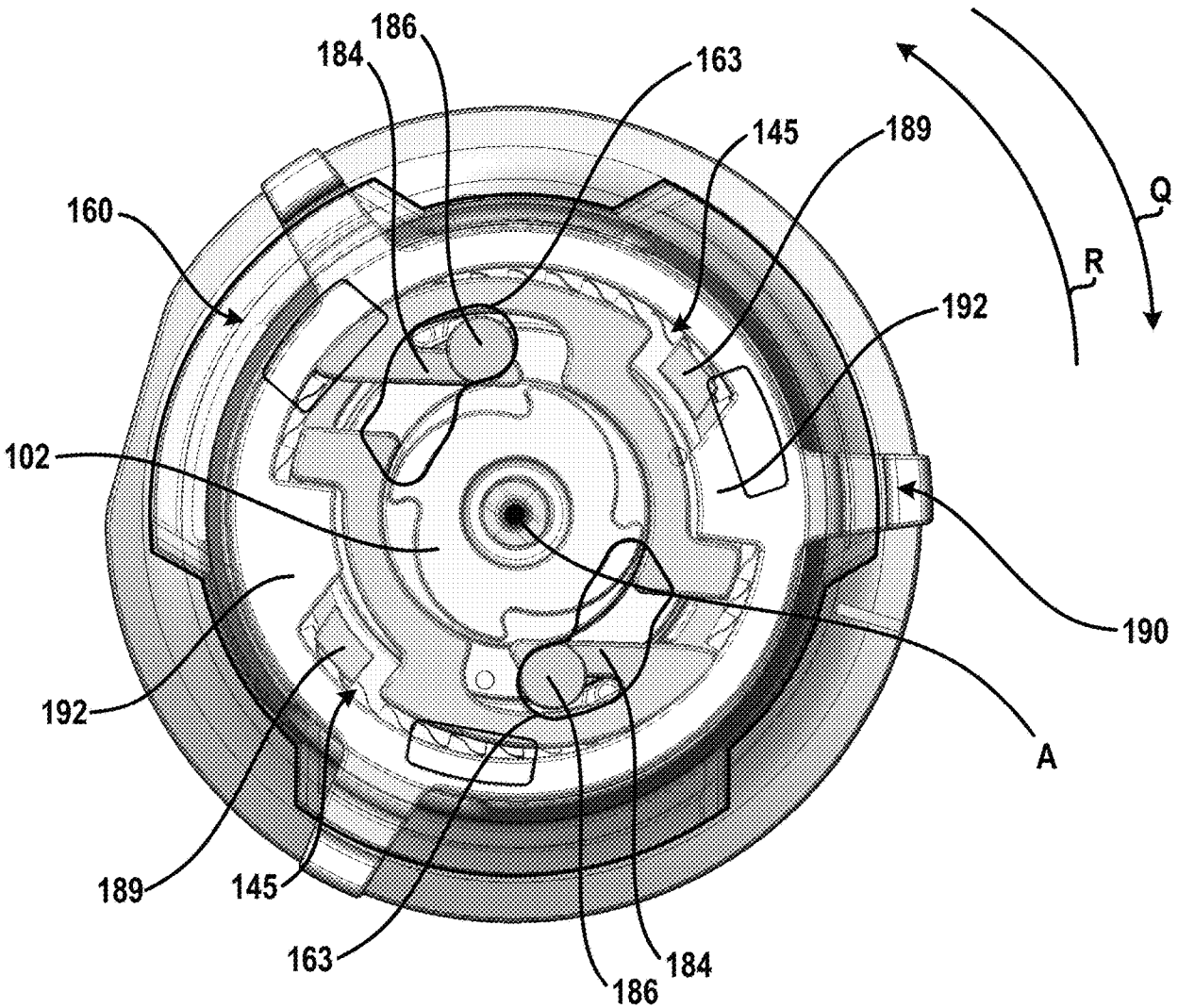
FIG. 4C is an illustration showing a top plan view of the micro-adjustable rotary closure of FIG. 4A showing the micro-adjustable rotary closure in a third "full-release" configuration.

With reference to FIGS. 4A-4C, the dial 106 can include the cam component 160 that, when rotated in the first rotational direction Q or the second rotational direction R, controls the tensioning component 108 to tension or fully de-tension the tensioned cylindrical device 102. In addition to the catch spring 187 discussed above, the tensioning component 108 includes a pawl spring 184 that releasably engages the tensioned cylindrical device 102 to rotate the tensioned cylindrical device 102 in the first rotational direction Q during "winding" of the tensioned cylindrical device 102, and prevents unintentional back-rotation of the tensioned cylindrical device 102 when at rest. The pawl spring 184 includes a cam follower 186 that engages a respective cam path 163 of the cam component 160. Based on a position of the cam follower 186 within the cam path 163, the pawl spring 184 can engage or disengage from the tensioned cylindrical device 102 to: actively tension the tensioned lacing element 198 (FIG. 2B) around the tensioned cylindrical device 102 (e.g., upon rotation of the cam component 160 of the dial 106 in the first rotational direction Q), hold a rotational position of the tensioned cylindrical device 102 relative to the tensioning component 108 (e.g., when the rotary closure 100 is at rest), or release the tensioned cylindrical device 102 from the tensioning component 108 (e.g., upon rotation of the cam component 160 of the dial 106 in the second rotational direction R). Actuation of the adjuster component 190 causes the tensioning component 108 to incrementally rotate in the second rotational direction R without changing a state of the pawl spring 184; when the tensioning component 108 is incrementally rotated in the second rotational direction R, the pawl spring 184 can maintain its engagement with the tensioned cylindrical device 102 and allow the tensioned cylindrical device 102 to incrementally rotate in the second rotational direction R concurrent with the tensioning component 108.

Resting State and "Winding" State

FIGS. 3A, 3B and 4A show the configuration of the components of the rotary closure 100 when at rest or when "winding" the tensioned cylindrical device 102. When at rest, the tensioning component 108 and the housing 104 hold the rotational position of the tensioned cylindrical device 102 at a fixed position. When the dial 106 is rotated in the first rotational direction Q, the tensioning component 108 and the tensioned cylindrical device 102 are concurrently rotated in the first rotational direction Q relative to the housing 104, while the tensioning component 108 incrementally engages the plurality of teeth 145 of the housing 104.

"Micro-Adjusting" State

FIGS. 3C and 4B show the configuration of the components of the rotary closure 100 when in a "micro-release" or "micro-adjust" state that enables controlled counterrotation of the tensioned cylindrical device 102 and tensioning component 108 by an incremental amount. The adjuster component 190 is positioned between the housing 104 and the dial 106 and around an outer edge of the tensioning component 108 as shown. When at rest or when the dial 106 is rotated in the first rotational direction Q, the adjuster component 190 is concurrently rotated in the first rotational direction Q along with the tensioning component 108 and the tensioned cylindrical device 102.

When the adjuster component 190 is rotated in the second rotational direction R (e.g., independent of the dial 106) the adjuster component 190 interacts with the tensioning component 108 to decouple the tensioning component 108 from the housing 104 and allow the tensioning component 108 and tensioned cylindrical device 102 to incrementally rotate in the second rotational direction R.

"Full-Release" State

FIG. 4C shows the configuration of the components of the rotary closure 100 when in a "full release" state that enables full counterrotation and de-tensioning of the tensioned cylindrical device 102 and tensioning component 108. When the dial 106 is rotated in the second rotational direction R, the cam paths 163 of the cam component 160 of the dial 106 interact with the tensioning component 108 to decouple the tensioning component 108 from the tensioned cylindrical device 102 and allow the tensioned cylindrical device 102 to fully de-tension.

Tensioned Cylindrical Device

Figure 5B:
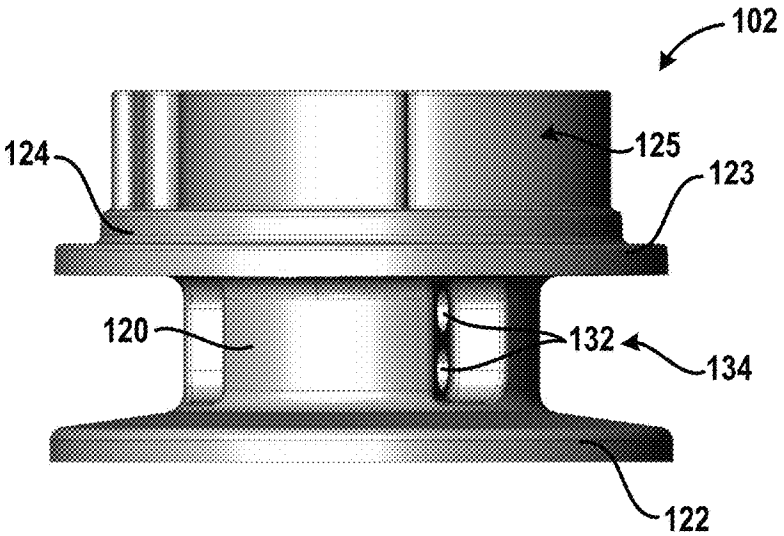
FIGS. 5A-5C are a series of illustrations respectively showing a top perspective view, a side view, and bottom perspective view of a tensioned cylindrical device of the micro-adjustable rotary closure of FIG. 1.
Figure 5C:
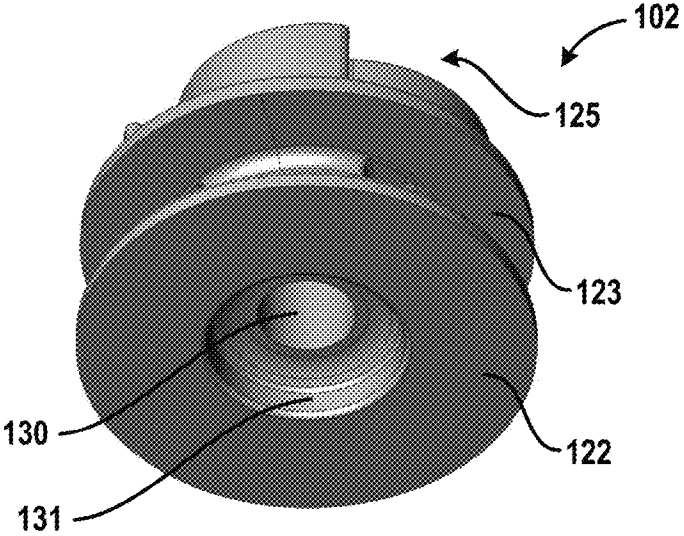
Figure 5A:
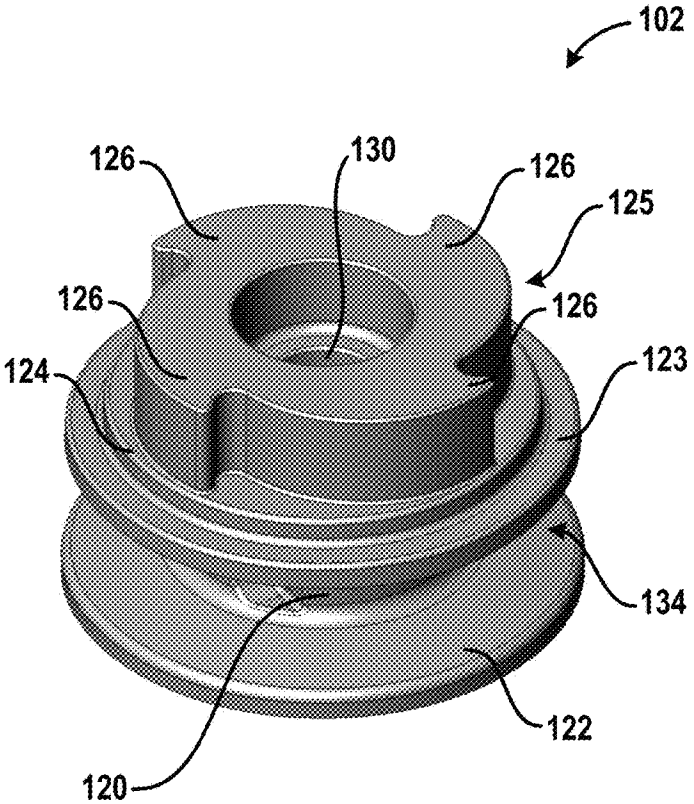

Referring to FIGS. 5A-5C, the tensioned cylindrical device 102 controls the operation of the tensioned lacing element 198 (FIG. 2B) such as a cable or wire. The tensioned cylindrical device 102 can be a spool, or can be another cylindrical device under tension in which it would be desirable to adjust a rotational position of the cylindrical device (e.g., such as an analog timer or another similar tensioning device). The tensioned cylindrical device 102 is seated within the housing 104 (as shown in FIG. 2B). In some embodiments, the tensioned cylindrical device 102 includes a body 120 forming a base portion 122 and a flange portion 123 that collectively define a lacing channel 134 for receipt of the tensioned lacing element 198. The tensioned cylindrical device 102 further defines an extension 125 that extends axially from the flange portion 123 for releasable engagement with the tensioning component 108. The extension 125 includes a plurality of curved teeth 126 that collectively form a plurality of recesses between respective ridges formed circumferentially around the extension 125. The curved teeth 126 are configured for operative and releasable engagement with the pawl spring 184 of the tensioning component 108 (FIGS. 4A-4C) for rotating the tensioned cylindrical device 102 in the first rotational direction Q, essentially "catching" the tensioned cylindrical device 102 and forcing the tensioned cylindrical device 102 to rotate in the first rotational direction Q along with the cam component 160. The tensioned cylindrical device 102 defines a distal-most keyway 130 running axially through the body 120 to receive the latching extension 161 when latching components of the rotary closure 100 together. The distal-most keyway 130 defines a keyway shoulder 131 at the base portion 122 for engagement with the latching extension 161. As further shown, the tensioned cylindrical device 102 defines one or more windows 132 formed through the body 120 to secure the tensioned lacing element 198 (FIG. 2B) to the body 120 of the tensioned cylindrical device 102. As shown, the flange portion 123 of the tensioned cylindrical device 102 further includes a centering ridge 124 that enables alignment of the tensioned cylindrical device 102 within the housing 104.

Housing

Figure 6B:
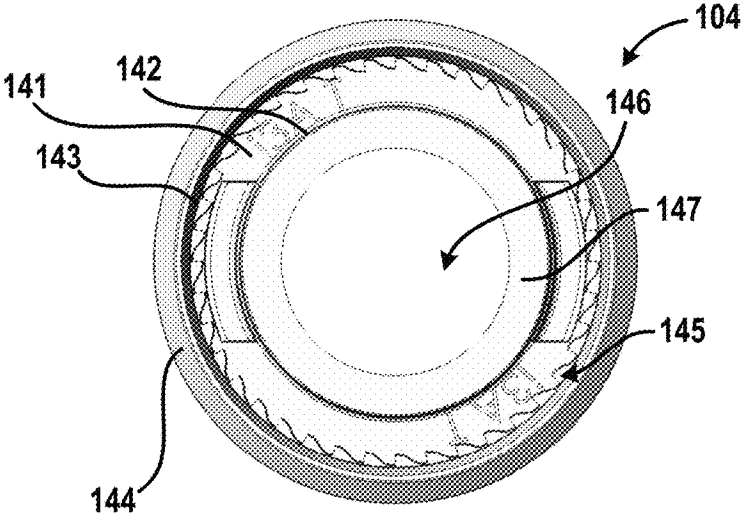
FIGS. 6A-6C are a series of illustrations respectively showing a top perspective view, a top plan view, and bottom plan view of a housing of the micro-adjustable rotary closure of FIG. 1.
Figure 6C:
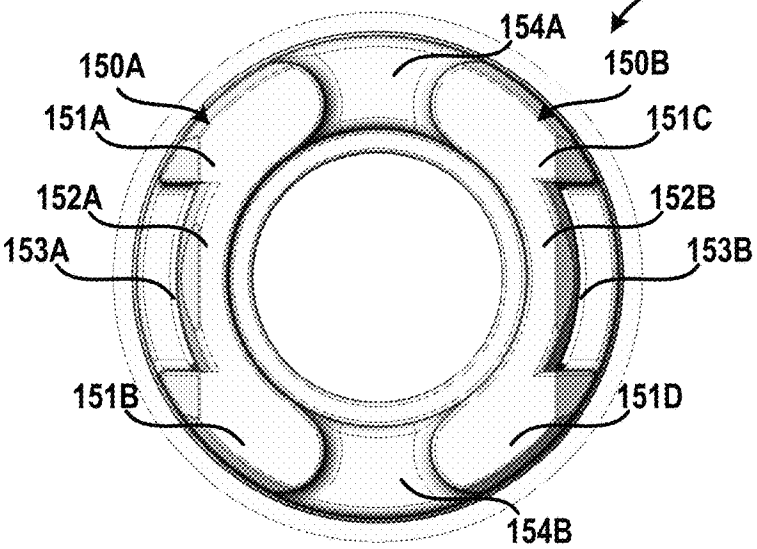
Figure 6A:
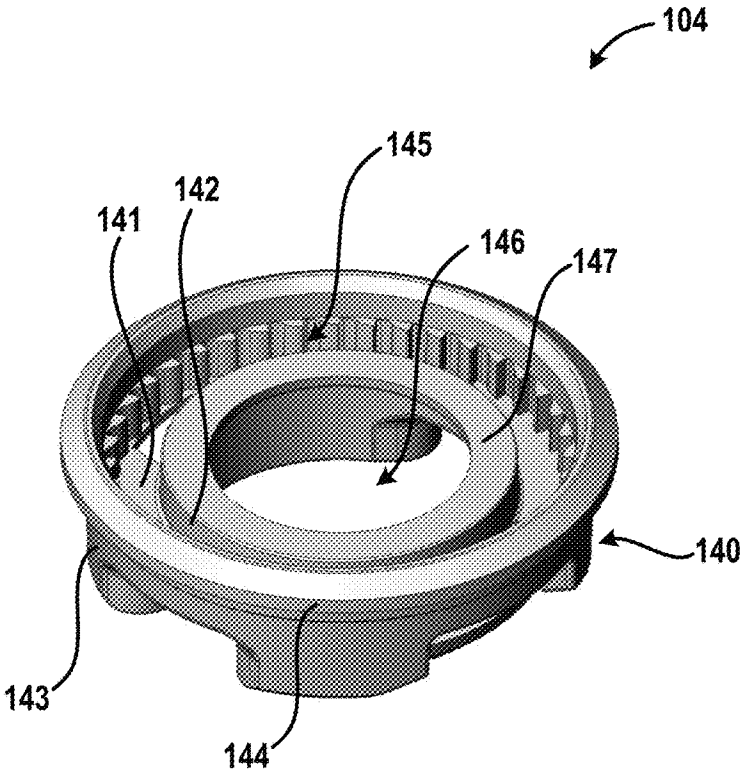

FIGS. 6A-6C illustrate the housing 104 for the rotary closure 100. In some embodiments, the housing 104 forms a body 140 defining an open configuration for receipt and rotation of the tensioned cylindrical device 102. In some embodiments, the body 140 defines an inner wall 142 formed coaxially within an outer wall 143, with a housing channel 141 therebetween for receipt of the catch spring 187 of the tensioning component 108 (FIGS. 2B-3C). As shown, the outer wall 143 defines a circumferential flange 144 configured for engagement with the cam component 160 (FIG. 2B) and a plurality of teeth 145 configured for incremental engagement with the catch spring 187. The plurality of teeth 145 of the housing 104 are configured to operatively engage the catch spring 187 of the tensioning component 108 in a snap-fit engagement as the dial 106, tensioning component 108 and tensioned cylindrical device 102 (FIG. 2B) are incrementally rotated in the first rotational direction Q. Further, engagement of the catch spring 187 with the plurality of teeth 145 of the housing 104 prevents unintentional counter-rotation of the tensioning component 108 in the second rotational direction R within the housing 104.

The housing 104 further defines an open receptacle 146 for receipt of the tensioned cylindrical device 102; a diameter of the open receptacle 146 can be "wide" enough to allow free rotation of the tensioned cylindrical device 102 within the open receptacle 146 when the tensioned cylindrical device 102 is released from the tensioning component 108. The inner wall 142 can include an inner flange 147 that engages the tensioned cylindrical device 102. When assembled, as shown in FIG. 2B, the open receptacle 146 partially encapsulates the tensioned cylindrical device 102 and exposes an underside of the tensioned cylindrical device 102 while the tensioned cylindrical device 102 is disposed within the housing 104.

In some embodiments, as shown in FIG. 6C, the housing 104 includes a pair of opposing arcuate plateaus including a first arcuate plateau 150A and a second arcuate plateau 150B formed on an underside of the housing channel 141. The first arcuate plateau 150A defines a first shoulder 151A at a first end of the first arcuate plateau 150A and a second shoulder 151B defined at a second end of the first arcuate plateau 150A. Similarly, the second arcuate plateau 150B defines a third shoulder 151C at a first end of the second arcuate plateau 150B and a fourth shoulder 151D defined at a second end of the second arcuate plateau 150B. As shown, the first arcuate plateau 150A defines a first arch 152A between the first shoulder 151A and the second shoulder 151B that collectively define a first closed slot 153A that engages the flange 110 (FIG. 1) during assembly of the rotary closure 100. Similarly, the second arcuate plateau 150B defines a second arch 152B between the third shoulder 151C and the fourth shoulder 151D that collectively define a second closed slot 153B that engages the flange 110 during assembly of the rotary closure 100.

The first and second arcuate plateaus 150A and 150B collectively define a first open slot 154A and a second open slot 154B configured for communication of one or more tensioned lacing elements 198 (FIG. 2B). Specifically, the first shoulder 151A of the first arcuate plateau 150A and the third shoulder 151C of the second arcuate plateau 150B collectively form the first open slot 154A. Similarly, the second shoulder 151B of the first arcuate plateau 150A and the fourth shoulder 151D of the second arcuate plateau 150B collectively form the second open slot 154B.

Dial and Cam Component

Figure 7B:
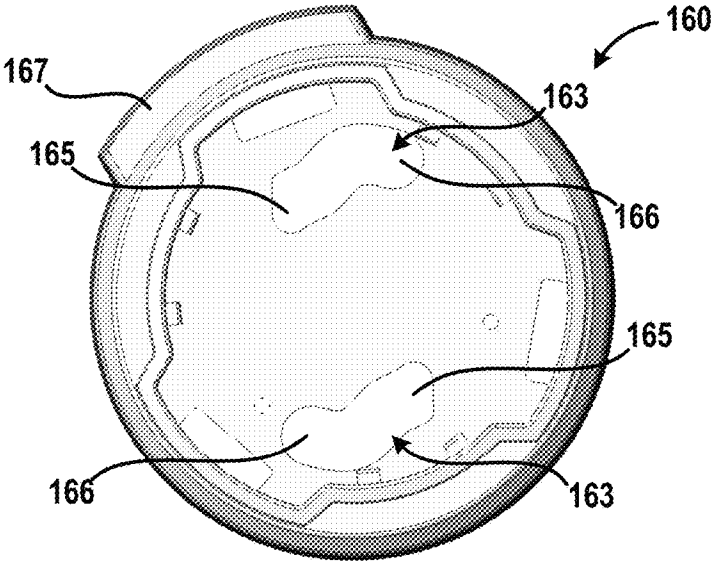
FIGS. 7A-7C are a series of illustrations showing a dial of the micro-adjustable rotary closure of FIG. 1, respectively including a top perspective view with a dial cover in phantom, a top plan view of a cam component of the dial, and a cutaway side view of the dial taken along line 7C-7C of FIG. 7A.
Figure 7A:
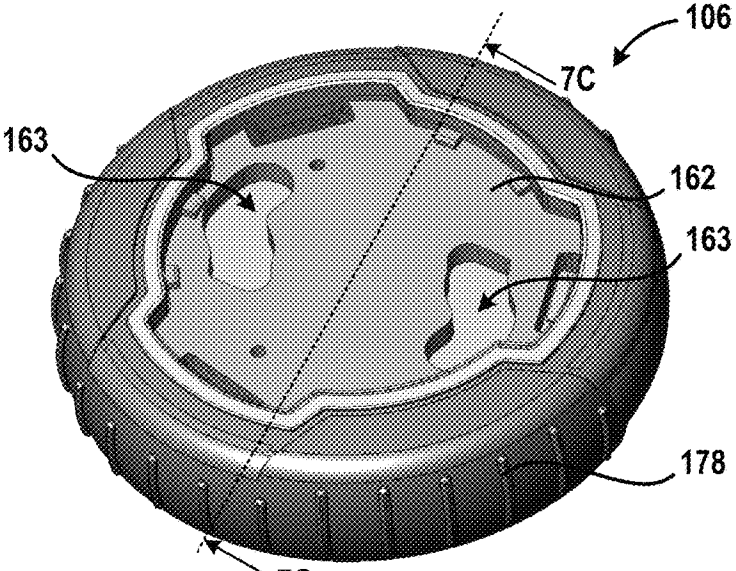
Figure 7C:
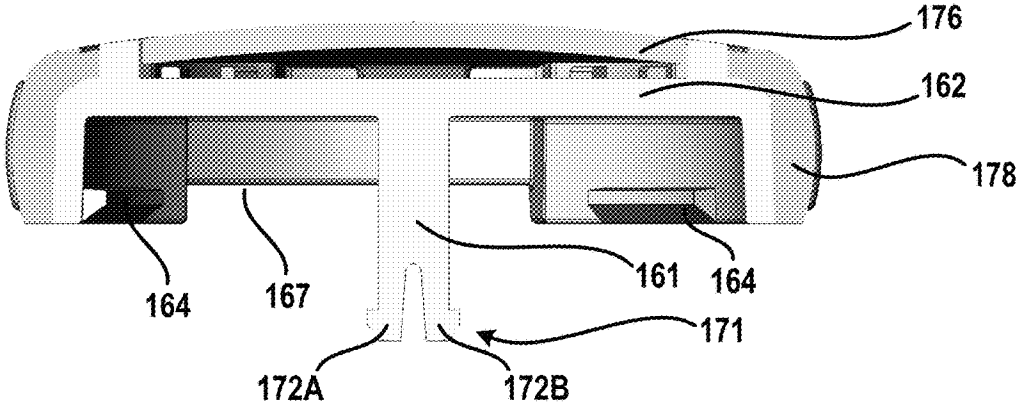

Referring to FIGS. 7A-7C, the cam component 160 can be integrally formed with the dial 106, or can be separable component that engages and rotates with one or more components of the dial 106. The cam component 160 defines a generally circular shape having a surface 162 that defines the (one or more) cam path(s) 163. The cam path 163 engages the cam follower 186 of the tensioning component 108 (FIGS. 4A-4C) and controls the state of the pawl spring 184, depending on a position of the cam follower 186 within the cam path 163. The cam path 163 includes a first portion 165 that positions the cam follower 186 in a default state of the pawl spring 184 in which the cam follower 186 and pawl spring 184 are positioned inward towards the common center axis A. When the cam follower 186 of the pawl spring 184 is within the first portion 165 of the cam path 163, the pawl spring 184 releasably engages the extension 125 of the tensioned cylindrical device 102. Rotation of the cam component 160 in the first rotational direction Q while the cam follower 186 is within the first portion 165 of the cam path 163 results in rotation of the tensioned cylindrical device 102 in the first rotational direction Q. When the rotary closure 100 is at rest, and also during operation of the adjuster component 190, the cam follower 186 can remain positioned within the first portion 165 of the cam path 163.

The cam path 163 further includes a second portion 166 that positions the cam follower 186 in a "full release" state of the pawl spring 184 upon rotation of the cam component 160 in the second rotational direction Q. While the cam follower 186 is positioned within the second portion 166 of the cam path 163, the cam follower 186 and pawl spring 184 are directed outward and away from the common center axis A to release the tensioned cylindrical device 102. When the cam follower 186 of the pawl spring 184 is positioned within the second portion 166 of the cam path 163, the pawl spring 184 decouples from and releases the extension 125 of the tensioned cylindrical device 102. The cam follower 186 can be returned to the first portion 165 of the cam path 163 by releasing the cam component 160 and allowing the pawl spring 184 to de-tension back into the default state in which the pawl spring 184 re-engages the tensioned cylindrical device 102.

As further shown, the dial 106 includes the latching extension 161 that extends inward from the surface 162 of the cam component 160 and terminates in a latching element 171. The latching extension 161 aligns with the common central axis A and engages the tensioned cylindrical device 102 (FIG. 2B) to latch together components of the rotary closure 100. In particular, the latching element 171 includes bifurcated first and second legs 172A and 172B configured for insertion through the distal-most keyway 130 of the tensioned cylindrical device 102 to engage with the keyway shoulder 131. Bifurcated first and second legs 172A and 172B define respective first and second tangs; when engaged with the flange 110 in an arrangement discussed herein, the first and second leg 172A and 172B are pushed apart, preventing disengagement of the tensioned cylindrical device 102 from the latching extension 161. Further, the cam component 160 can include a plurality of snap elements 164 that engage the circumferential flange 144 of the housing 104.

As shown, the cam component 160 includes one or more portals 167 for communication of the outer tab 195 of the adjuster component 190.

In some embodiments, the dial 106 includes a gripping portion 178 that enables manual gripping and rotation of the cam component 160. The dial 106 can optionally include a cover element 176 that couples with the cam component 160 to provide a smooth outer surface for the rotary closure 100.

Tensioning Component

Figure 8B:
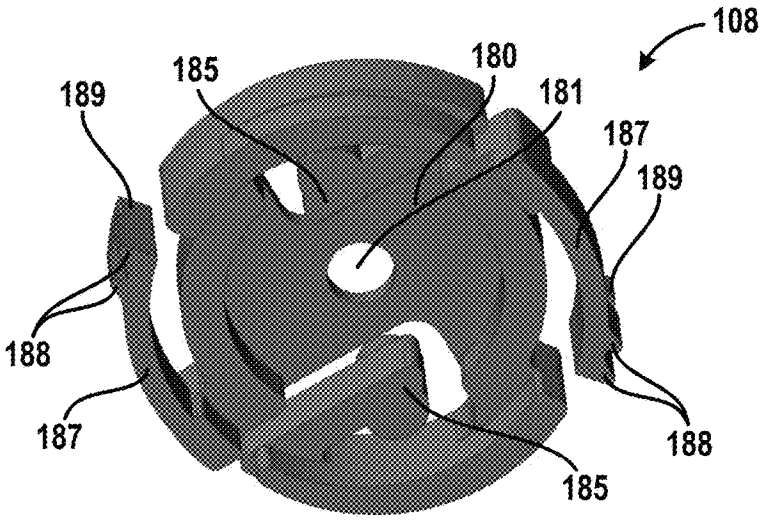
FIGS. 8A-8C are a series of illustrations showing a top perspective view, a bottom perspective view, and a top plan view of a tensioning component of the micro-adjustable rotary closure of FIG. 1.
Figure 8C:
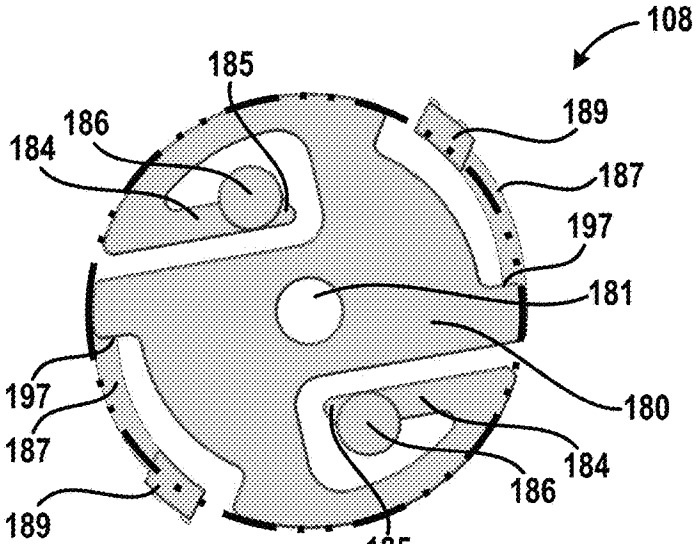
Figure 8A:
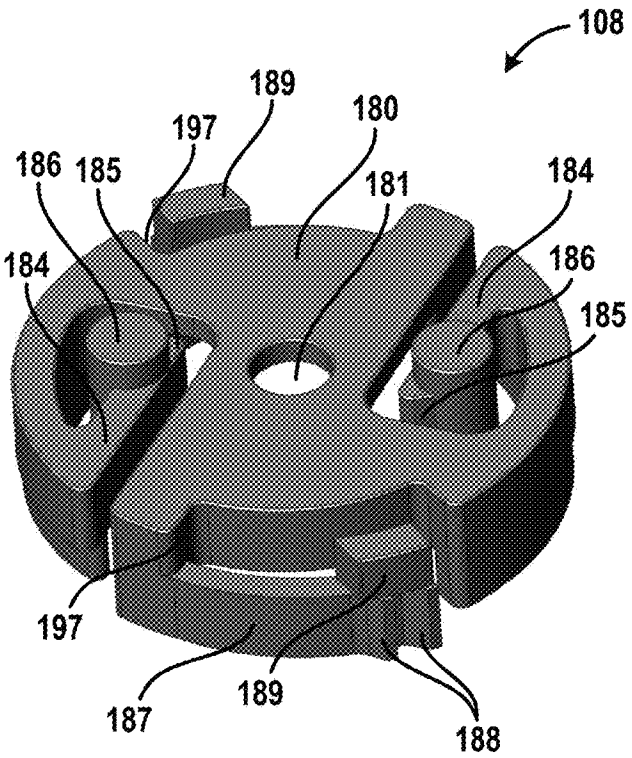

Referring to FIGS. 8A-8C, the tensioning component 108 is configured to engage the cam component 160 and the housing 104 to control rotation of the tensioned cylindrical device 102. In addition, the tensioning component 108 operates with the adjuster component 190 to enable incremental de-tensioning of the tensioned cylindrical device 102 without completely de-tensioning the tensioned cylindrical device 102. The tensioning component 108 defines a spring body 180 defining a keyway 181 for insertion of the latching extension 161 of the dial 106 (FIG. 2B). Further, the tensioning component 108 defines the one or more pawl springs 184 located interior to the spring body 180 that operatively engage the extension 125 of the tensioned cylindrical device 102 and the cam paths 163 of the cam component 160 (FIGS. 4A-4C). The pawl spring 184 is configurable in two states: (1) the default state of the pawl spring 184 which engages the tensioned cylindrical device 102 for rotating the tensioned cylindrical device 102 in the first rotational direction Q and prevents back-rotation of the tensioned cylindrical device 102 in the second rotational direction R when at rest; and (2) the "full release" state in which the cam component 160 actuates the pawl spring 184 away from the common center axis A and releases the tensioned cylindrical device 102, allowing the tensioned cylindrical device 102 to rotate in the second direction R. As illustrated, the pawl spring 184 includes the cam follower 186 that extends from the pawl spring 184 and engages the cam path 163 of the cam component 160. The state of the pawl spring 184 is dependent upon the position of the cam follower 186 within the cam path 163 of the cam component 160: when the cam follower 186 is within the first portion 165 of the cam path 163, the pawl spring 184 releasably engages the extension 125 of the tensioned cylindrical device 102; when the cam follower 186 is within the second portion 166 of the cam path 163, the pawl spring 184 releases the extension 125 of the tensioned cylindrical device 102 to allow the tensioned cylindrical device 102 to rotate in the second direction and fully de-tension.

Additionally, the tensioning component 108 also includes the catch spring 187 oriented along an outer edge of the spring body 180 of the tensioning component 108. The catch spring 187 incrementally engages the housing 104 (FIGS. 4A-4C) to prevent back-rotation of the tensioning component 108 and tensioned cylindrical device 102 in the second rotational direction R when the rotary closure 100 is at rest, and can define a shoulder 197 and the catch spring block 189 in operative association with the adjuster component 190 to allow incremental micro-rotation of the tensioning component 108 and tensioned cylindrical device 102 in the second rotational direction R. As shown, the catch spring 187 includes a plurality of tangs 188 that incrementally engage two or more of the plurality of teeth 145 of the housing 104 as the tensioning component 108 is rotated in the first rotational direction Q while preventing counter-rotation in the second rotational direction R. In some embodiments, as shown in FIG. 8C, the catch spring 187 is oriented outward and away from the common center axis A, outside circle C which denotes the outer edge of the spring body 180.

When engaged within the housing channel 141 of the housing 104 and when rotated in the first rotational direction Q as shown in FIGS. 3B and 4A, the catch spring 187 is forced inward towards the common center axis A by the teeth 145 of the housing 104, and then snaps back outward away from the common center axis A to engage the teeth 145 of the housing 104 at an advanced radial position along the housing channel 141 of the housing 104. As shown in FIGS. 3C and 4B, when the adjuster component 190 is rotated in the second direction R, the catch spring block 189 of the catch spring 187 is also moved inward by the adjuster component 190. This action disengages the catch spring 187 from the teeth 145 of the housing 104 and incrementally rotates the tensioning component 108 in the second rotational direction R. After rotating by an incremental amount in the second rotational direction R, the catch spring 187 pushes itself outward from the common center axis A to re-engage the housing 104 and return to the configuration shown in FIGS. 3B and 4A due to outwardly-directed tension on the catch spring 187 and limited rotation range of the adjuster component 190. As such, the adjuster component 190 enables controlled micro-adjustment of the tensioned lacing element around the tensioned cylindrical device 102 without having to completely de-tension and re-wind the tensioned cylindrical device 102.

The pawl spring 184 includes a pawl member 185 at a distal portion of the pawl spring 184 that directly engages the curved teeth 126 of the extension 125 of the tensioned cylindrical device 102 to force rotation of the tensioned cylindrical device 102 in the first rotational direction Q and to prevent back-rotation of the tensioned cylindrical device 102 in the second rotational direction R when in the default state shown in FIG. 4A (e.g., when the cam follower 186 of the pawl spring 184 is located at the first portion 165 along the cam path 163 of the cam component 160).

The pawl member 185 is also operable for disengagement from the curved teeth 126 of the extension 125 of the tensioned cylindrical device 102 when in the "full release" state shown in FIG. 4C. The pawl spring 184 transitions into the "full release" state by counter-rotation of the cam component 160 in the second direction R such that the cam follower 186 of the pawl spring 184 enters the second portion 166 of the cam path 163 of the cam component 160, thereby forcing the pawl member 185 outward and away from the common center axis A and the extension 125 of the tensioned cylindrical device 102. This action releases the tensioned cylindrical device 102 and enables the tensioned cylindrical device 102 to rotate freely within the housing 104 without influence from the pawl spring 184.

In some embodiments the spring body 180 of the tensioning component 108 can be enclosed as shown in the embodiment of FIGS. 3A-3C and 8A-8C, in other embodiments the spring body 180 is shown with an open body as shown in FIGS. 4A-4C The tensioning component 108, particularly the pawl spring 184 and the catch spring 187, are comprised of a strong by flexible material that tensions when deformed and returns to its original position when released.

Adjuster Component

Figure 9A:
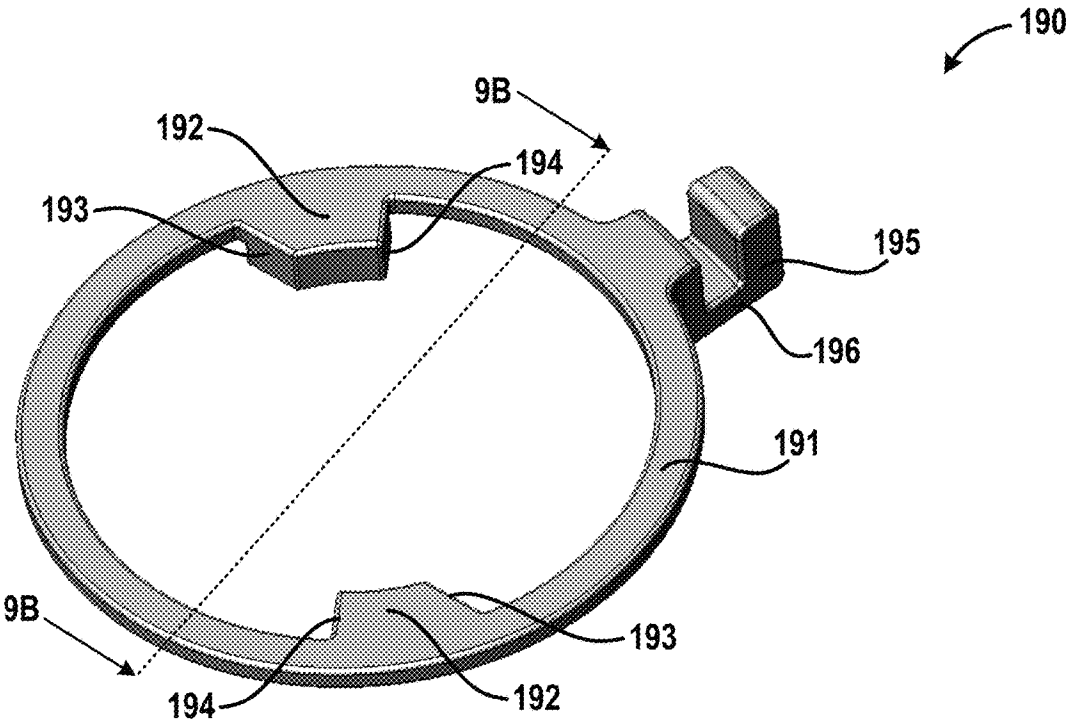
FIGS. 9A and 9B are a pair of illustrations showing an adjuster component of the micro-adjustable rotary closure of FIG. 1, respectively including a top perspective view and a cutaway side view taken along line 9B-9B of FIG. 9A.
Figure 9B:
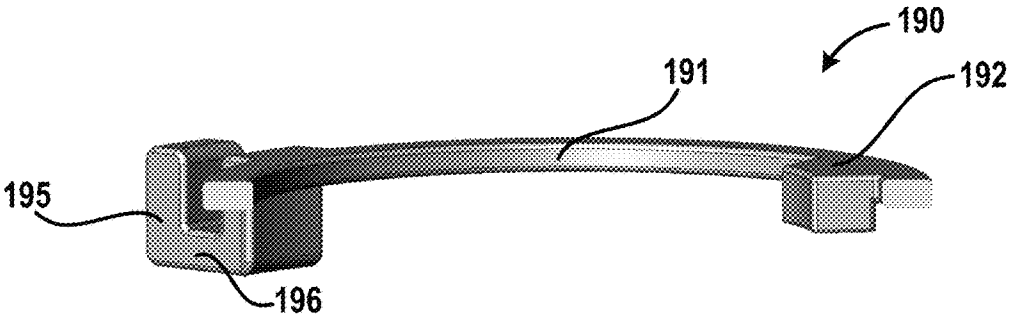

FIGS. 9A and 9B illustrate the adjuster component 190 that enables the tensioning component 108 to incrementally rotate in the second rotational direction R to "loosen" the tensioned cylindrical device 102 without completely de-tensioning the tensioned cylindrical device 102. In particular, the adjuster component 190 defines a ring-shaped body 191 having the adjuster block 192 defined interior to the ring-shaped body 191 and operatively associated with the catch spring 187 of the tensioning component 108. The adjuster block 192 includes the angled edge 193 that contacts the catch spring block 189 of the catch spring 187 during rotation of the adjuster component 190 in the second rotational direction R, drawing the catch spring block 189 inward towards the common center axis A. This action disengages the plurality of tangs 188 of the catch spring block 189 from the plurality of teeth 145 of the housing 104 as the tensioning component 108 and the tensioned cylindrical device 102 are allowed to de-tension by an increment. The amount of counter-rotation of the tensioned cylindrical device 102 enabled by the adjuster component 190 can be limited to an incremental value to allow controlled micro-rotation of the tensioning component 108 and the tensioned cylindrical device 102 in the second rotational direction R. As discussed, catch spring 187 is biased away from the common center axis A, and when the adjuster component 190 is released, the catch spring 187 pushes the catch spring block 189 outward and away from the common center axis A to re-engage the housing 104. This prevents further rotation of the tensioning component 108 and the tensioned cylindrical device 102 in the second rotational direction R, enabling micro-adjustment of the tensioned cylindrical device 102 by a controlled incremental value without completely de-tensioning the tensioned cylindrical device 102. Additionally, the motion of the catch spring block 189 returning to engage the housing 104 continually contacts the angled edge 193 of the adjuster block 192 and causes the adjuster component 190 to rotate back to its default position relative to the housing 104. Rotation of the adjuster component 190 to incrementally de-tension the tensioned cylindrical device 102 can be repeated as many times as necessary until a comfortable tension is reached.

The adjuster block 192 additionally defines a stopping edge 194 that fits against the shoulder 197 of the catch spring 187 when in the default position. The ring-shaped body 191 further includes the outer tab 195 that extends beyond the dial 106 and enables a user to rotate the adjuster component 190 in the second rotational direction R. The outer tab 195 can define an elbow portion 196 that enables the outer tab 195 to extend underneath and beyond the dial 106 as shown in FIGS. 2A and 4A-4C. In one aspect, the amount of rotation of the adjuster component 190 at each manual rotation can be limited by a length of the catch spring 187; in particular, a distance from the shoulder 197 of the catch spring 187 to the catch spring block 189. This distance can be selected to limit how far the tensioned cylindrical device 102 and tensioning component 108 can be rotated in the second rotational direction R.

Flange

Figure 10B:
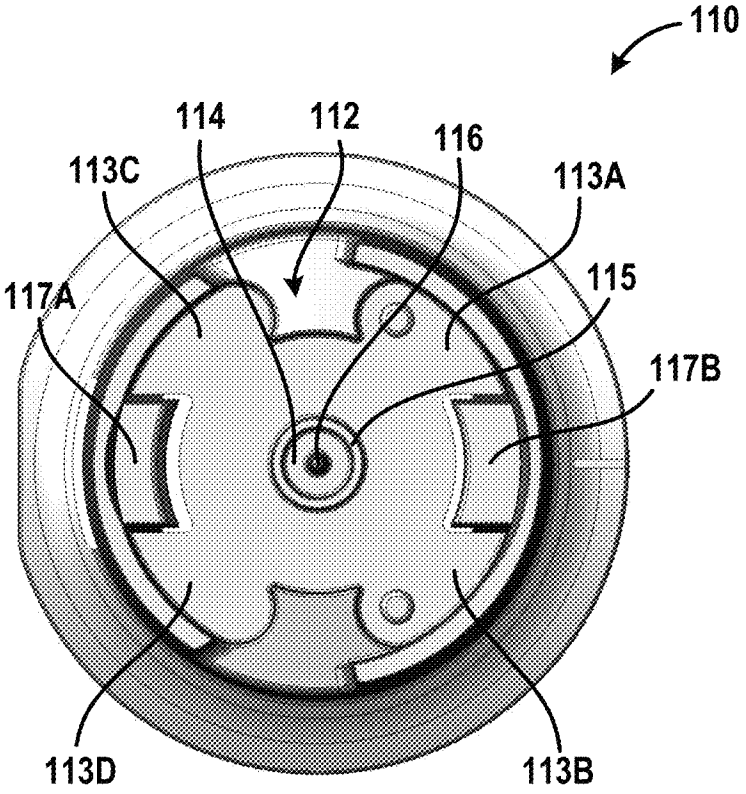
FIGS. 10A and 10B are a pair of illustrations respectively showing a top perspective view and a top plan view a flange of the micro-adjustable rotary closure of FIG. 1.
Figure 10A:
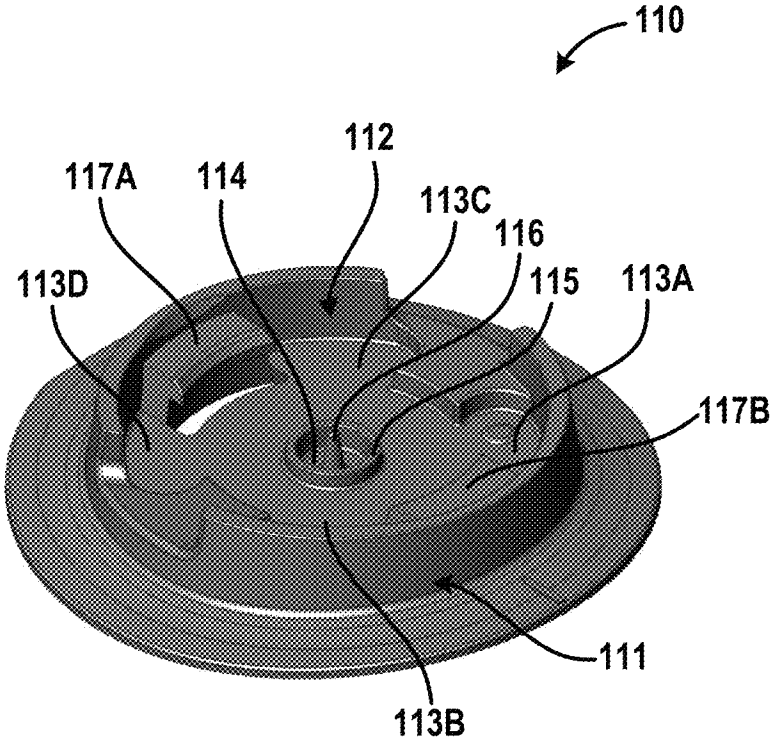

Referring to FIGS. 10A and 10B, in some embodiments the flange 110 is configured to couple the assembled components of the rotary closure 100 to a shoe by engagement with the housing 104. In some embodiments, the flange 110 defines a body 111 having a circular shape with a bowed cross section forming a housing receptacle 112 on one side that is configured to engage the housing 104 during assembly. The housing receptacle 112 forms a plurality of seats 113A, 113B, 113C and 113D to accept respective shoulders 151A-D (FIG. 6C) of the housing 104 and a central depression 114 to accommodate the latching element 171 of the latching extension 161. In some embodiments, the central depression 114 defines a ring 115 surrounding a central protrusion 116 within the central depression 114. The central protrusion 116 is configured to engage between the first leg 172A (FIG. 2B) and the second leg 172B of the latching extension 161 to bias the first and second legs 172A and 172B apart and prevent the latching extension 161 from disengaging from the tensioned cylindrical device 102. The flange 110 further includes a first retention member 117A formed opposite a second retention member 117B configured to engage opposite sides of the housing 104 to the flange 110. In some embodiments, the first and second retention members 117A and 117B form tang portions at the free ends thereof that are configured to couple with the housing 104 in a snap fit engagement.

Tensioning and De-Tensioning

To tension the tensioned cylindrical device 102, the dial 106 including the cam component 160 is rotated in the first rotational direction Q. Rotation of the cam component 160 relative to the tensioning component 108 positions the cam follower 186 of the tensioning component 108 within the first portion 165 of the cam path 163. With the cam follower 186 in the first portion 165 of the cam path 163 as the cam component 160 rotates, the tensioning component 108 is consequently rotated in the first rotational direction Q. As a result, the pawl spring 184 forces the tensioned cylindrical device 102 to rotate in the first rotational direction Q. The catch springs 187 incrementally engage with the plurality of teeth 145 of the housing 104 to prevent back-rotation of the tensioning component 108 in the second rotational direction R.

To de-tension the tensioned cylindrical device 102 by one increment, the adjuster component 190 is rotated in the second rotational direction R relative to the other components of the rotary closure 100. Rotation of the adjuster component 190 causes the angled edge 193 of the adjuster block 192 to contact the catch spring block 189 and push the catch spring block 189 inward towards the common center axis A of the rotary closure 100, disengaging the catch spring 187 from the plurality of teeth 145 of the housing 104 and enabling the tensioning component 108 and the tensioned cylindrical device 102 to rotate in the second rotational direction R. The catch spring 187 is then forced outward again to engage the plurality of teeth 145 of the housing 104. During micro-adjustment, the pawl spring 184 does not move relative to the tensioned cylindrical device 102.

To completely de-tension the tensioned cylindrical device 102, the dial 106 including the cam component 160 is rotated in the second rotational direction R. Rotation of the cam component 160 relative to the tensioning component 108 positions the cam follower 186 of the tensioning component 108 within the second portion 166 of the cam path 163. With the cam follower 186 in the second portion 166 of the cam path 163 as the cam component 160 rotates, the pawl spring 184 is drawn outward and away from the common central axis A, releasing the extension 125 of the tensioned cylindrical device 102 and enabling the tensioned cylindrical device 102 to de-tension and rotate freely in the second rotational direction R. The catch springs 187 engage the plurality of teeth 145 of the housing 104 to prevent back-rotation of the tensioning component 108 in the second rotational direction R.

Methods

Figure 11:
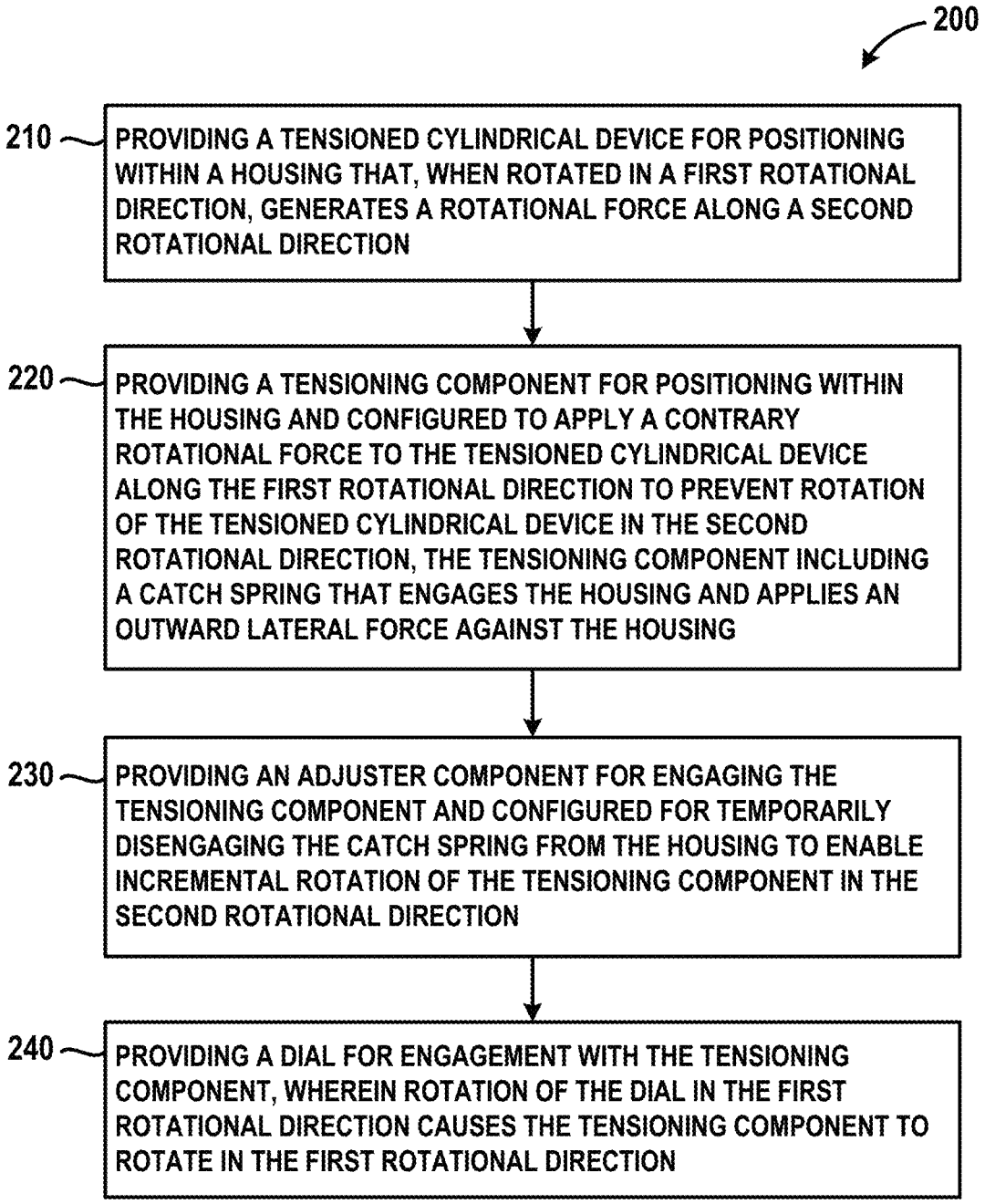
FIG. 11 is a process flow diagram showing a method for providing the micro-adjustable rotary closure of FIG. 1.

FIG. 11 shows a method 200 for providing the rotary closure of FIGS. 1-4C.

As shown, step 210 of method 200 includes providing a tensioned cylindrical device (e.g., tensioned cylindrical device 102) for positioning within a housing (e.g., housing 104) that, when rotated in a first rotational direction, generates a rotational force along a second rotational direction.

Step 220 of method 200 includes providing a tensioning component (e.g., tensioning component 108, including pawl spring 184) for positioning within the housing and configured to apply a contrary rotational force to the tensioned cylindrical device along the first rotational direction to prevent rotation of the tensioned cylindrical device in the second rotational direction, the tensioning component including a catch spring (e.g., catch spring 187) that engages the housing and applies an outward lateral force against the housing.

Step 230 of method 200 includes providing an adjuster component (e.g., adjuster component 190) for engaging the tensioning component and configured for temporarily disengaging the catch spring from the housing to enable incremental rotation of the tensioning component in the second rotational direction. The adjuster component is operable for rotation around the tensioning component and includes an adjuster block (e.g., adjuster block 192) that, when rotated in the second rotational direction and upon contact with the catch spring, causes the catch spring to disengage the housing and enable incremental rotation of the tensioning component in the second rotational direction. Release of the adjuster component following disengagement of the catch spring from the housing causes the catch spring to re-engage the housing and prevent further rotation of the tensioned cylindrical device in the second rotational direction.

Step 240 of method 200 includes providing a dial (e.g., dial 106, including cam component 160) for engagement with the tensioning component. Rotation of the dial in the first rotational direction causes the tensioning component to rotate in the first rotational direction. Rotation of the dial in the second rotational direction causes the tensioning component to disengage the tensioned cylindrical device.

As used herein, the terms "coupled" and/or "engaged" refers to components being mechanically connected to each another either directly or indirectly or through one or more intermediary components. It is also appreciated that the illustrated devices and structures may include a plurality of the same component referenced by the same number. It is appreciated that depending on the context, the description may interchangeably refer to an individual component or use a plural form of the given component(s) with the corresponding reference number.

References to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments. Thus, the present technology can include a variety of combinations and/or integrations of the embodiments and features described herein.

It should be understood from the foregoing that, while particular embodiments have been illustrated and described, various modifications can be made thereto without departing from the spirit and scope of the invention as will be apparent to those skilled in the art. Such changes and modifications are within the scope and teachings of this invention as defined in the claims appended hereto.

What is claimed is:

1. A rotary closure, comprising:

an adjuster component defining an adjuster block having an angled edge;

a tensioned cylindrical device disposed within a housing, the tensioned cylindrical device configured for receipt of a tensioned lacing element; and a tensioning component in operative association with the tensioned cylindrical device and the adjuster component that applies a contrary rotational force to the tensioned cylindrical device along a first rotational direction, the tensioning component including:

a catch spring configured to engage the housing and prevent rotation of the tensioning component in a second rotational direction when the catch spring is engaged with the housing;

wherein rotation of the adjuster component in the second rotational direction causes the angled edge to contact the catch spring and cause the catch spring to disengage from the housing such that the tensioning component is allowed to rotate in the second rotational direction, and wherein the adjuster component further includes an outer tab that extends beyond the housing.

2. The rotary closure of claim 1, wherein the catch spring is configured to releasably engage a plurality of teeth of the housing to advance a rotational position of the tensioning component in a first rotational direction along the plurality of teeth of the housing when the tensioning component is rotated in the first rotational direction.

3. The rotary closure of claim 2, wherein the plurality of teeth of the housing are angled to allow the catch spring of the tensioning component to move radially inward and then snap radially outward again as the tensioning component is rotated in the first rotational direction.

4. The rotary closure of claim 1, wherein the angled edge of the adjuster component contacts a catch spring block of the catch spring during rotation of the adjuster component in the second rotational direction and pushes the catch spring block inward towards a common center axis.

5. The rotary closure of claim 1, wherein the catch spring is biased away from a common center axis of the rotary closure such that the catch spring is oriented away from the common center axis when in an un-tensioned state.

6. The rotary closure of claim 5, wherein the catch spring pushes a catch spring block of the catch spring outward from the common center axis to engage the housing.

7. A device for incremental adjustment of a rotational position of a tensioned cylindrical device within a housing, comprising:

a tensioned cylindrical device positioned within a housing that, when rotated in a first rotational direction, generates a rotational force along a second rotational direction;

a tensioning component positioned within the housing configured to apply a contrary rotational force along the first rotational direction to prevent rotation of the tensioned cylindrical device in the second rotational direction, the tensioning component including a catch spring that engages the housing and applies an outward lateral force against the housing, and a pawl member configured to engage the tensioned cylindrical device and apply the contrary rotational force to the tensioned cylindrical device along the first rotational direction to prevent rotation of the tensioned cylindrical device in the second rotational direction;

wherein the pawl member is operable to disengage the tensioned cylindrical device upon rotation of a dial in the second rotational direction; and an adjuster component configured for temporarily disengaging the catch spring from the housing to enable incremental rotation of the tensioning component in the second rotational direction.

8. The device of claim 7, wherein incremental rotation of the tensioning component in the second rotational direction enables incremental rotation of the tensioned cylindrical device in the second rotational direction.

9. The device of claim 7, wherein the adjuster component is operable for rotation around the tensioning component and wherein the adjuster component includes an adjuster block that, when rotated in the second rotational direction and upon contact with the catch spring, causes the catch spring to disengage the housing and enable incremental rotation of the tensioning component in the second rotational direction.

10. The device of claim 9, wherein release of the adjuster component following disengagement of the catch spring from the housing causes the catch spring to re-engage the housing and prevent further rotation of the tensioned cylindrical device in the second rotational direction.

11. The device of claim 7, wherein the catch spring is configured to releasably engage a plurality of teeth of the housing to advance a rotational position of the tensioning component in the first rotational direction along the plurality of teeth of the housing when the tensioning component is rotated in the first rotational direction.

12. The device of claim 11, wherein the plurality of teeth of the housing are angled to allow the catch spring of the tensioning component to move radially inward and then snap radially outward again as the tensioning component is rotated in the first rotational direction.

13. The device of claim 7, wherein rotation of the dial in the first rotational direction, rotates the tensioning component in the first rotational direction.

14. The device of claim 13, wherein rotation of the dial in the second rotational direction causes the tensioning component to disengage the tensioned cylindrical device.

15. The device of claim 13, wherein the dial includes a cam component that engages a cam follower of the tensioning component to disengage the tensioning component from the tensioned cylindrical device.

16. A method, comprising:

providing a tensioned cylindrical device for positioning within a housing that, when rotated in a first rotational direction, generates a rotational force along a second rotational direction;

providing a tensioning component for positioning within the housing and configured to apply a contrary rotational force to the tensioned cylindrical device along the first rotational direction to prevent rotation of the tensioned cylindrical device in the second rotational direction, the tensioning component including a catch spring that engages the housing and applies an outward lateral force against the housing and a pawl member configured to engage the tensioned cylindrical device and apply the contrary rotational force to the tensioned cylindrical device along the first rotational direction to prevent rotation of the tensioned cylindrical device in the second rotational direction, wherein the pawl member is operable to disengage the tensioned cylindrical device upon rotation of a dial in the second rotational direction; and providing an adjuster component for engaging the tensioning component and configured for temporarily disengaging the catch spring from the housing to enable incremental rotation of the tensioning component in the second rotational direction.

17. The method of claim 16, wherein the adjuster component is operable for rotation around the tensioning component and wherein the adjuster component includes:

an adjuster block that, when rotated in the second rotational direction and upon contact with the catch spring, causes the catch spring to disengage the housing and enable incremental rotation of the tensioning component in the second rotational direction;

wherein release of the adjuster component following disengagement of the catch spring from the housing causes the catch spring to re-engage the housing and prevent further rotation of the tensioned cylindrical device in the second rotational direction.

18. The method of claim 16, further comprising:

providing the dial for engagement with the tensioning component, wherein rotation of the dial in the first rotational direction causes the tensioning component to rotate in the first rotational direction.

* * * * *